US011401778B1

(12) United States Patent
Saraya

(10) Patent No.: US 11,401,778 B1
(45) Date of Patent: Aug. 2, 2022

(54) METHODS AND SYSTEMS FOR CASING DISCONNECT SYSTEM WITH LINER TOP TESTING

(71) Applicant: Vertice Oil Tools Inc., Missouri City, TX (US)

(72) Inventor: Mohamed Saraya, Sugarland, TX (US)

(73) Assignee: Vertice Oil Tools Inc., Stafford, TX (US)

( * ) Notice: Subject to any disclaimer, the term of this patent is extended or adjusted under 35 U.S.C. 154(b) by 0 days.

(21) Appl. No.: 17/337,170

(22) Filed: Jun. 2, 2021

(51) Int. Cl.

| | |
|---|---|
| ***E21B 33/16*** | (2006.01) |
| ***E21B 34/14*** | (2006.01) |
| ***E21B 23/06*** | (2006.01) |
| ***E21B 34/06*** | (2006.01) |
| ***E21B 17/08*** | (2006.01) |
| *E21B 47/117* | (2012.01) |
| *E21B 43/26* | (2006.01) |

(52) U.S. Cl.
CPC ..... *E21B 33/16* (2013.01); *E21B 17/08* (2013.01); *E21B 23/06* (2013.01); *E21B 34/063* (2013.01); *E21B 34/142* (2020.05); *E21B 43/26* (2013.01); *E21B 47/117* (2020.05)

(58) Field of Classification Search
CPC ..... E21B 33/16; E21B 34/142; E21B 34/063; E21B 17/08; E21B 23/06; E21B 47/117; E21B 43/26
See application file for complete search history.

(56) References Cited

U.S. PATENT DOCUMENTS

| | | | | |
|---|---|---|---|---|
| 5,133,412 | A * | 7/1992 | Coronado | E21B 17/06 166/123 |
| 5,864,057 | A * | 1/1999 | Baird | E21B 49/083 73/152.38 |
| 6,439,305 | B1 * | 8/2002 | Bakke | E21B 17/06 166/242.6 |
| 9,267,338 | B1 * | 2/2016 | LeBlanc | E21B 17/06 |
| 10,435,958 | B1 * | 10/2019 | Saraya | E21B 17/06 |
| 2013/0199795 | A1 * | 8/2013 | Williamson | E21B 47/00 166/162 |
| 2014/0102716 | A1 * | 4/2014 | Benson | E21B 41/0035 166/381 |

* cited by examiner

*Primary Examiner* — Christopher J Sebesta
(74) *Attorney, Agent, or Firm* — Pierson IP, PLLC

(57) ABSTRACT

Interventionless testing casing within a wellbore to determine a location where the casing is leaking. Testing systems include a casing disconnect tool to receive an object, such as a ball, allowing for pressurizing to test a backside between new casing associated with the disconnect tool and older casing associated with a cased hole or open hole.

20 Claims, 18 Drawing Sheets

METHODS AND SYSTEMS FOR CASING DISCONNECT SYSTEM WITH LINER TOP TESTING

BACKGROUND INFORMATION

Field of the Disclosure

Examples of the present disclosure relate to a casing disconnect tool that receives an object to allow pressurizing to test a backside between new casing associated with the disconnect tool and older annulus associated with a cased hole or open hole, wherein the object may be run on a rod and configured to be pulled out of the hole together.

Background

Hydraulic fracturing is the process of creating cracks or fractures in underground geological formations. After creating the cracks or fractures, a mixture of water, sand, and other chemical additives, are pumped into the cracks or fractures to protect the integrity of the geological formation and enhance production of the natural resources. The cracks or fractures are maintained opened by the mixture, allowing the natural resources within the geological formation to flow into a wellbore, where it is collected at the surface.

Conventionally, in oil and gas operations, casing is run all way to the surface to allow for the hydraulic fracturing. Other methods can include hanging or dropping the casing just above a horizontal or deviated section using a packer, a liner hanger, combination of both. Although this can be a cheaper method, it is still expensive and increases operational complexity.

Further, for refracturing jobs new casing must be run for a targeted zone, which must be isolated. This requires running new casing within the hole, pumping cement inside the casing, allowing the cement to return up hole in an annulus between the new casing and the old casing, and launching a wiper plug to sweep the pumped cement out of the new casing. Then, it is required to test this new casing/casing top to ensure pressure integrity before starting normal fracing procedure.

Conventionally, to test the casing is requiring to pressure up within the new casing. In normal situations the new casing interior and liner top hold pressure, requiring no further operation. However, some situations occur where the pressure up indicates there is leaking associated with the new casing/casing top. However, the locations of the leaking may be unknown, where the leaking may occur within the old casing or the shoe of the casing due to the wiper plug not landing properly. Currently to determine the location of the leaking it is required to position an object on the new casing shoe, isolate the new casing shoe from the liner top, pressure up above the retrievable packer or the plug, determine the location of the leak, perform a squeeze job if liner top is the cause of leak and then remove the object. This is an arduous and complex task that requires substantial effort, rig/coiled tubing time and money.

Specifically, in refracturing operations when the object is positioned within a depleted well, a vacuum may be created in a first area below the object. When combined with pressures caused by hydrostatic head on a first area above the object, the forces created by the pressure differential across the object may be too substantial to pull the object out of the hole.

Accordingly, needs exist for systems and methods for systems and methods for an object to be run in hole on a rod, wherein pressure across the object may be equalized.

SUMMARY

Embodiments disclosed herein describe systems and methods for interventionless testing of new casing associated with a disconnect tool for new casing, wherein a squeeze job can be performed within the casing without running additional tools downhole. The disconnect tool may be configured to set new casing downhole with cement positioned in an annulus between an outer diameter of the new casing and an inner diameter of a cased hole or open hole. After positioning the disconnect tool downhole, the upper part of the disconnect tool can be then retrieved, leaving the new casing with a full open bore. To allow for later testing of the casing, the new casing run in hole via the disconnect tool that includes a profile configured to receive an object or ball on rod. After the ball is positioned on the profile, pressurizing may occur above the ball to determine if there is leaking associated with the new casing top. Based on the pressure readings after the testing it may be determined if the targeted zone leak requires a squeeze job. However, if the testing indicates that the targeted zone is not leaking it may be assumed that there is a wet shoe that is leaking.

In implementations, cement may be pumped downhole through the tool and be recirculated in an annulus between the tool and the existing casing or wellbore wall. A wiper plug may be pumped downhole, after pumping the cement, and through the tool to remove the cement from within tool and the new casing internal diameter. The wiper plug then lands on a landing collar/landing shoe at the bottom of the new casing on previously deployed casing to form a seal at the bottom of the new casing. Then operations may be performed to disconnect the upper sub-assembly, support sleeve, and adjuster sleeve from the wellbore the housing and the bottom sub-assembly, and remove the upper sub-assembly, support sleeve, and adjuster sleeve from the wellbore while the housing and the bottom sub-assembly remain downhole.

Once the new casing is set and conventionally tested by applying pressure from the surface, a leak may be detected and it is desired to test the new casing within the wellbore formed of the new cement, housing, and the bottom sub-assembly to determine a location of the leak. An object run in hole by pumping or coupled to a rod may be positioned downhole within or above the housing or bottom sub-assembly without reducing the standard internal diameter of the casing, allowing the creation of two isolated fluid chambers, wherein a first chamber is positioned above the ball and a second chamber positioned below the ball. In some situations, the pressurization above the object may indicate that there is a leak associated with a backside positioned within an annulus between the outer diameter of the tool and the old casing, and a squeeze job may be required. This type of leak is called in common practice liner top leak. If the pressurization above the ball indicates that there is no leak on the backside, then it may be determined that the tool has a wet shoe. Then, the rod and object may be pulled out of the hole together. Accordingly, no milling is required for a squeeze job downhole, and the squeeze job and testing can be performed in a single run downhole. In other embodiments, where it is certain a cement squeeze job may be needed, and after the disconnect operation, the support sleeve maybe directly connected with the seal assembly directly. Then, another batch of cement may be displaced above the release ball associated with the disconnect tool, and cement can be directly bull headed on the back side between the new casing and the old casing.

In implementations, when the ball or object is positioned on a seat for a refracturing operation, situations may occur where a well is depleted across the object. This creates a substantial pressure differential across the object created by hydrostatic head and the vacuum of the depleted well, making it very difficult to pull the object out of the hole.

In embodiments, the downhole tool associated with the rod and object may include an outer housing, temporary coupling mechanism, inner mandrel, and rod.

The outer housing may include a shaft, object, and passageway.

The shaft may be configured to extend from a first end of the outer housing towards the second end of the outer housing. In embodiments, the shaft may have a first outer diameter.

The object may be positioned on a second end of the outer housing or any location between the first end and second end of the outer housing. The object may have a second outer diameter that is larger than the first outer diameter. The object may be configured to form a seal between an outer profile of the object and a seat, casing, or any other element positioned adjacent to the outer profile of the housing. In embodiments, the outer profile of the object may include chevron packing seals that are formed of a set of "V" shaped components that when brought together form a complete packing assembly or they may be any other packing element, i.e.: bonded seals. Accordingly, when the object is positioned on a seat or other location, communication between the outer surface of the object and the seat may be restricted. In further embodiments, the object may be formed of a dissolvable material, which may reduce a size of across the outer diameter of the object over time.

The passageway may be a hollow passageway extending within a body of the outer housing from the first end to the second end of the outer housing. The passageway may include a first groove and a no-go. The first groove may be configured to extend from an inner surface of the passageway towards the outer surface of the outer housing. A first portion of the temporary coupling mechanism may be configured to be inserted into the first groove. The no-go may be a ledge that is configured to restrict movement of the inner mandrel in a first direction. The ledge may reduce a diameter across the passageway, such that a projection positioned on an outer surface of the inner mandrel may not move past the ledge. Accordingly, the passageway may have varying diameters, wherein a diameter of the passageway proximate to the second end is larger in size than the diameter of the passageway proximate to the first end of the passageway. Furthermore, the ledge may be configured to receive forces from the inner mandrel, such that when the inner mandrel is pulled out of the hole the outer housing is simultaneously pulled out of the hole.

The temporary coupling mechanism may be a shear pin, shear screw, or any other element that is configured to temporarily couple the outer housing and the inner mandrel at a first location. The temporary coupling mechanism may have a first end that is configured to be inserted into the first groove and a second end that is configured to be inserted into a second groove within the inner mandrel. Responsive to applying force to the temporary coupling mechanism that is greater than a pressure threshold, the temporary coupling mechanism may break. This may allow the inner mandrel to move relative to a static outer housing. In embodiments, the force threshold to break the temporary coupling mechanism may be less than a threshold associated with the emergency disconnect tool disengaging force, which is usually part of the running string.

The inner mandrel may be configured to move along an axis to selectively allow communication through the passageway. The inner mandrel may include a proximal end, second groove, seal, shaft, bypass, and distal end.

The proximal end of the inner mandrel may be configured to be inserted into the rod. This may allow the rod to translate forces to the inner mandrel to run the inner mandrel downhole in a second direction, shear the temporary coupling mechanism, and move the inner mandrel up hole in a first direction. In embodiments, the proximal end may be configured to be permanently coupled to the rod or selectively coupled to the rod via secondary temporary coupling mechanisms, which may shear at a second pressure threshold that is larger than the pressure threshold needed to shear the temporary coupling mechanisms that couple the inner mandrel and the outer housing together.

The second groove may extend from an outer surface of the inner mandrel towards a central axis of the inner mandrel. The second groove may be configured to receive a second portion of the temporary coupling mechanism, which may temporarily couple the inner mandrel and the outer housing at the first location.

The seal may be a device that is configured to be positioned against a surface defining the passageway to seal the passageway when the inner mandrel is coupled to the outer housing in the first position. In embodiments, the seal may be an O-ring, metal to metal seal, or any other type of sealing mechanism. Responsive to shearing the temporary coupling mechanism and moving the inner mandrel to be in a second position, the seal may not be positioned within the passageway. This may allow communication of fluid through an annulus between an outer surface of the inner mandrel and the surface defining the passageway.

The shaft may extend between the seal and the distal end of the inner mandrel, the shaft may have an outer diameter that is smaller than the diameter across the passageway. This may allow an annulus to be formed between the shaft and the passageway.

The bypass may include a conduit and ports. The conduit may extend through a body of the inner mandrel from the distalmost end of the inner mandrel. The ports may extend from an outer surface of the shaft to the conduit. The bypass may allow fluid to flow between the annulus formed by the shaft and passageway, through the ports, and out of the conduit to an area below the object.

The distal end of the inner mandrel may be configured to be positioned within the passageway between the ledge within the profile and the second end of the outer housing. The distal end may have a projection with an outer diameter that is substantially the same as the diameter of the passageway between the ledge and the second end of the outer housing. This may enable the distal end of the inner mandrel to form a seal between the outer surface of the distal end and the surface defining the passageway, which may force communication through the inner mandrel to occur through the bypass. In embodiments, when the inner mandrel is in the first position, the distal end of the inner mandrel may be flush with the second end of the outer housing. Responsive to the temporary coupling mechanism shearing and the inner mandrel moving in the first direction, while the outer housing remains static, the projection may be positioned adjacent to the no-go within the passageway. The movement of the relative movement of inner mandrel with respect to the outer housing may be restricted based on the projection being positioned against the no-go. This may force the outer housing and the inner mandrel to be pulled out of the hole together.

The rod may be mounted and run on wireline, slick line, coiled tubing, stick pipe or any other type of shaft that is configured to receive forces and translate the forces to the inner mandrel. The rod may include an orifice, cavity, etc. that is configured to receive the proximal end of the inner mandrel. A lower surface of the rod may be configured to be positioned adjacent to the first end of the outer housing when the inner mandrel is in the first position.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
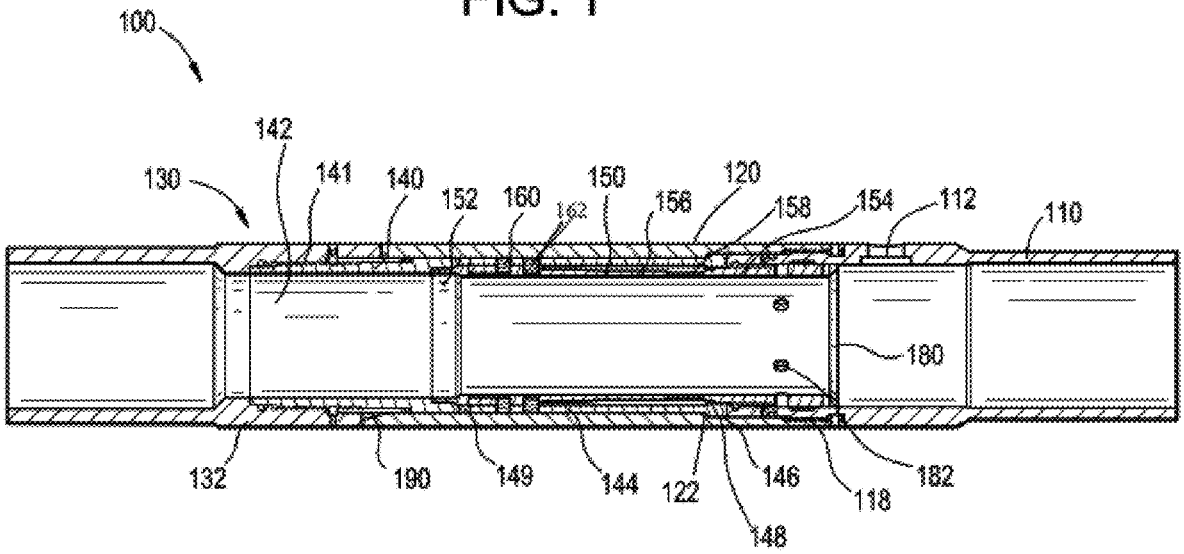
FIG. 1 depicts a tool, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

FIG. 1 depicts a detachable tool 100 for use in a wellbore, according to an embodiment. In embodiments, the detachable tool 100 may be configured to be run in hole (RIH) as a unitary tool with a balanced pressure, wherein the connection between elements is not shearable while being RIH. In embodiments, a shearing element, such as a shear pin may be connected to a support sleeve 150, which supports the collet, and may be balanced as long as a ball is not seated on a ball seat. This may enable shearable, burstable, etc. elements of tool 100 to remain intact while being RIH. Tool 100 may include a bottom sub-assembly 110, housing 120, and upper-sub assembly 130.

Bottom sub-assembly 110 may be configured to be positioned at a distal end of a wellbore on a shoe. The bottom sub-assembly 110 may be configured to be a permanent part of casing, and remain within the wellbore after upper sub-assembly 130 is disconnected from housing 120. Bottom sub-assembly 110 may be configured to be positioned adjacent to casing liner downhole within the wellbore, and be configured to be coupled with a seal bore extension. This may be configured to seal an annulus between new casing and the old casing from the new casing internal diameter. Bottom sub-assembly 110 may include a burst disc 112, and coupling mechanism 118. In other embodiments, burst disc 112 may be included in the upper-sub assembly 130.

Burst disc 112 may be configured to be positioned in a passageway that extends from an inner diameter of tool 100 to an annulus positioned between tool 100 and another structure, such as an outside casing or a geological formation. Burst disc 112 may be configured to rupture, break, fragment, dissolve, etc. by applying a predetermined pressure across the rupture disc or after a predetermined amount of time. In embodiments, before burst disc 112 is ruptured or removed the annulus between an outer diameter of tool 100 and the inner diameter of tool 100 may be isolated from each other. Responsive to burst disc 112 being ruptured or removed, there may be communication between the annulus and the inner diameter of tool 100 via the exposed passageway. This may enable excess cement and fluid to travel through the passageway and towards the surface. In other embodiments, the burst disc may be placed in the housing or the upper sub-assembly 130 or directly adjacent to the collet. In other embodiments, where a cement squeeze job is determined upfront before positioning tool 100 downhole, the burst disc 112 may allow displacement of extra cement above the disconnect tool 100, wherein disconnect tool 100 is coupled with seal assembly 920 from below. When the support sleeve 150 is coupled with the seal assembly 920, the cement can be displaced to the annulus side between the new casing and the old casing, and cement squeeze job can be performed via bull heading the well. The seal assembly 920 and the disconnect ball 310 on the support sleeve 150 shall prevent any communication between the annulus and the new casing internal diameter, which may ensure that all of the squeeze cement goes to annulus.

Coupling mechanisms 118 may be positioned on an outer diameter of the proximal end of bottom sub-assembly 110. The coupling mechanisms 118 may be configured to selectively couple bottom sub-assembly 110 and housing 120. This may allow housing 120 to remain downhole after upper sub-assembly 130 is retrieved from the hole. In other embodiments, bottom sub-assembly 110 and housing 120 may be a single, unified part that requires no connection.

Housing 120 may be a sidewall with an outer diameter that is configured to be positioned adjacent to an outer casing, wall, cement, or geological formation. In embodiments, a distal end of housing 120 may be coupled to bottom sub-assembly 110, and a proximal end of housing 120 may be coupled to top sub-assembly 130. The proximal end of housing 120 may include a beveled anti-rotational lock 190. Anti-rotational lock 190 may be configured to limit the rotation of upper sub-assembly 130 with respect to the housing 120. The anti-rotational lock 190 may include a first set of fingers and a first set of grooves, which may be configured to be interfaced with a second set of fingers and a second set of grooves on the outer sidewall of the upper sub-assembly. In embodiments, the beveled, sloped, tapered, etc. edges, of anti-rotational lock 190 may be configured to assist with re-entry of further tools within an inner diameter housing 120.

An upper portion of housing 120 may have a first inner diameter, and a bottom portion of housing 120 may have a second inner diameter, wherein the second inner diameter is greater than the first inner diameter. A stop, no-go, outcrop, etc. 122 may be positioned between the upper and lower portions of housing 120, wherein no-go 122 may be configured to limit the movement of upper sub-assembly 130 when shear pin 160 is coupling adjuster sleeve 140 and support sleeve 150. As such, when adjuster sleeve 140 and support sleeve 150 are coupled together via shear pin 160, no-go 122 may form an overhang over portions of adjuster sleeve 140. This may limit the movement of upper sub-assembly towards the proximal end of tool 100 when portions of adjuster sleeve 140 are aligned with no-go 122. However, when portions of adjuster sleeve 140 are not aligned with no-go 122, upper sub-assembly 130 may move towards the proximal end of tool 100. This may enable the removal of upper sub-assembly 130. In an alternative embodiment, the no-go 122 may be part of the bottom sub-assembly 110 while the collet 144 may be connected to the upper sub-assembly. In further embodiments, housing 120 may include a ball seat, projection, etc. that is position on an inner diameter of housing 120. The ball seat may be configured to receive a ball after upper sub-assembly is disconnected from housing and removed from the wellbore. In such embodiment, with the ball seat positioned on the housing, rupture disc 112 may be removed from bottom sub assembly 110, or positioned on upper sub assembly 130.

Upper sub-assembly 130 is configured to be inserted and removed from a wellbore independently from bottom sub-assembly 110 and/or housing 120. Responsive to increasing the pressure or apply of force within tool 100, portions of upper sub-assembly may be repositioned and form a mechanical look that is not aligned with housing 120. This may allow upper sub-assembly 130 to move towards the proximal end of the wellbore. Upper sub-assembly 130 may include an outer sidewall 132, adjuster sleeve 140, and a support sleeve 150. Further, in other embodiments, upper sub-assembly 130 may include rupture disc 112. Further, in other embodiments, the distal end of support sleeve 150 may be connected to seal assembly 920.

Outer sidewall 132 may be configured to be positioned on and adjacent to a proximal end of housing 120. By positioning outer sidewall 132 on housing 120, movement of upper sub-assembly 130 towards the distal end of tool 100 may be limited. An inner portion of outer sidewall 132 may be configured to be coupled to a proximal end of adjuster sleeve 140. A distal end of outer sidewall 132 may include an anti-rotational lock that is configured to mate with anti-rotational lock 190. Responsive to mating the anti-rotational locks, the rotation of upper sub-assembly 130 with respect to the housing 120 may be limited. The second set of anti-rotational locks positioned on the distal end of outer sidewall may include a second set of fingers and a second set of grooves. These second sets of fingers and grooves may be configured to be offset from the first set of fingers of grooves. For example, a first finger associated with the housing 120 is inserted into a second groove associated with the outer sidewall 132 and a second finger associated with outer sidewall 132 is configured to be inserted into a first groove housing 120.

Adjuster sleeve 140 may be a sleeve with a collet that is configured to remain coupled to outer sidewall 132 while support sleeve 150 moves towards a distal end of the wellbore. Adjuster sleeve 140 may include a coupling mechanism 141, upper portion 142, shear pin 160, shaft 144, and a distal end that includes an outer projection 146 and an inner projection 148, and port 149.

The upper portion 142 of adjuster sleeve 140 may be configured to be coupled with outer sidewall 132 via coupling mechanism 141. Upper portion 142 may include a cutout 170 that is configured to receive a proximal end of support sleeve 150, when support sleeve 150 is in a first position. In embodiments, support sleeve 150 may be retained in the first position until the pressure within tool 100 increases past a threshold to cut/severe shear pin 160. This may decouple adjuster sleeve 140 and support sleeve 150 at a location associated with shear pin 160. In other embodiments, the adjuster sleeve 140 and the outer side wall 132 may be one piece.

Shaft 144 may be positioned between upper portion 142 and the distal end of adjuster sleeve 140. Shaft 144 may be configured to be positioned adjacent to an inner sidewall of housing 120 while upper sub-assembly 130 is coupled with bottom sub-assembly 110. Shaft 144 may be configured to extend past shear pins 160 from upper portion 142 to the collet positioned on a distal end of adjuster sleeve 140. An inner diameter across shaft 144 may be greater than an inner diameter across the distal end of adjuster sleeve 140 and upper portion 142. In embodiments, shaft 144 may be spring loaded, have a natural flex, etc. that naturally moves the distal end of shaft 144 towards a central axis of tool 100. In other configurations, the shaft can be connecting to dogs, dies, etc.

Distal end of adjuster sleeve 140 may be a collet or any other mechanism that is configured to be selectively coupled to housing 120 at a first location or support sleeve 150 at a second location. This may enable upper sub-assembly 130 to be selectively coupled to bottom sub-assembly 110, while allowing upper sub-assembly 130 to be mechanically removed from a wellbore. Distal end of adjuster sleeve 140 may include an outer projection 146 and an inner projection 148. In other embodiments, support sleeve 150 distal end may be directly coupled to a seal assembly 920 for utilization in one trip squeeze job after disconnecting the upper sub-assembly 130 from the lower sub assembly 110 and housing 120.

Outer projection 146 may be positioned on an outer sidewall of the distal end of adjuster sleeve 140, and may increase the outer diameter of the distal end of adjuster sleeve 140. Outer projection 146 may be configured to be vertically aligned with no-go 122 in the first mode of operation. This may limit the upward movement of adjuster sleeve 140 while outer projection 146 is aligned with no-go 122. In the second mode, outer projection 146 may not be aligned with no-go 122, such the adjuster sleeve 140 may move unrestricted by no-go 122.

The outer projection 146 may be collets that flex open, dies that retract, dogs supported with spring, or any other device that naturally or through mechanical assistance may have first larger diameter and second smaller diameters Inner projection 148 may be positioned on an inner sidewall of the distal end of adjuster sleeve 140, and may decrease the inner diameter of the distal end of adjuster sleeve 140. Inner projection 146 may be configured to be positioned adjacent to first outcrop 154 of support sleeve 150 in the first mode of operation. In the second mode of operation, inner projection 146 may be configured to be positioned within a groove between first outcrop 154 and second outcrop 156, and may be positioned adjacent to second outcrop 156. This may enable inner projection to apply a force against second outcrop 156 and move support sleeve 150.

Port 149 may be an orifice extending from an inner circumference of adjuster sleeve 140 to an outer circumference of adjuster sleeve 140. Port 149 may be positioned closer to a proximal end of adjuster sleeve 140 than a distal end of adjuster sleeve 140. Port 149 may be configured to allow communication between an inner diameter of adjuster sleeve 140 and an annulus outside of adjuster sleeve 140 while upper sub-assembly 130 is being removed from the wellbore. However, shear pin 160 is coupling adjuster sleeve 140 and support sleeve 150, an inlet of port 149 may be covered by support sleeve 150 and an outlet of port 149 may be covered by housing 120. Furthermore, when upper sub-assembly 130 is being removed from the wellbore, a proximal end of support sleeve 150 may be positioned below port 149, which may allow for the communication between the inner diameter of adjuster sleeve 140 and the annulus.

Support sleeve 150 may be a device that is configured to be selectively coupled to adjuster sleeve 140 at either a first location or second location, and to move along a linear axis of tool 100. Support sleeve 150 may move towards a distal end of tool 100 responsive to a ball drop and seating on seat 152 and a pressure increase within tool 100, and may move towards a proximal end of tool 100 responsive to adjuster sleeve 140 applying pressure to support sleeve 150 towards the proximal end of tool 100. Support sleeve 150 may include a seat 152, first outcrop 154, and second outcrop 156.

Seat 152 may be a projection extending around the inner circumference of support sleeve 150, which may decrease the inner diameter of support sleeve 150. Seat 152 may be configured to receive a ball, disc, object, seal, etc., and restrict the movement of the ball towards the distal end of tool 100. This may isolate a first area within the tool 100 above seat 152 from a second area within the tool 100 below seat 152. In embodiments, responsive to positioning the ball on seat 152, the pressure within the first area may increase, shearing pin 160, and moving support sleeve 150 towards the distal end of tool 100. In further embodiments, seat 152 may be coupled with an inner support that is configured to mechanically intervene and shear shearing pin 160. This may enable a failsafe to disconnect the upper sub-assembly 130 from bottom sub-assembly that is mechanically operated. In other embodiments, when the support sleeve 150 distal end is connected to the seal assembly 920, the ball and the ball seat 152 coupled with the seal assembly 920 may continue to isolate the first area above the tool from the second area below the tool allowing fresh cement to be displaced through the passageway housing a removed rupture disc 112, which is included in the upper-sub assembly 130, out to the annulus between the new casing and old casing. Hence, a cement squeeze job can be achieved via bull heading.

First outcrop 154 and second outcrop 156 may be positioned on an outer diameter of support sleeve 150. First outcrop 154 and second outcrop 156 may increase the size of the outer diameter of support sleeve 150 such that a slot 158 may be formed between first outcrop 154 and second outcrop 156. In embodiments, first outcrop 154 may have a smaller outer diameter than that of second outcrop 156.

First outcrop 154 may be configured to be aligned with inner projection 148 in the first mode, which may limit the movement of the distal end of adjuster sleeve 140 towards a central axis of tool 100. In the second mode, the distal end of adjuster sleeve 140 may be aligned the groove/slot between first outcrop 154 and second outcrop 156, and the distal end of adjuster sleeve 140 may be coupled to support sleeve 150 at a second location.

Support sleeve 150 may also include a tapered distal end 180, and ports 182. The tapered distal end 180 may be a beveled, slopped, angled, etc. end that is configured to assist in positioning support sleeve within bottom sub-assembly 110. Ports 182 may be configured to allow for a communication bypass around the proximal end of support sleeve 150, between support sleeve 150 and adjuster sleeve 140 when the two are detached, and into the inner diameter of bottom sub assembly 110. This communication bypass may be configured to allow for a pressure drop indication within the wellbore due to the shearing or shear pin 160. Support sleeve 160 may be coupled to adjuster sleeve 140 via retaining pins 162, which couple the support sleeve 150 to adjuster sleeve 140 after support sleeve 150 has sheared. In other embodiments, bypass ports 182 may be eliminated and a seal assembly 920 maybe directly connected to the distal end 180 of the support sleeve 150. The seal assembly 920 may have a first end that is directly coupled to distal end 180, and positioned initially within bottom sub assembly 110. Seal assembly 920 may also have a second end that is positioned outside and below bottom sub assembly 110.

Figure 2:
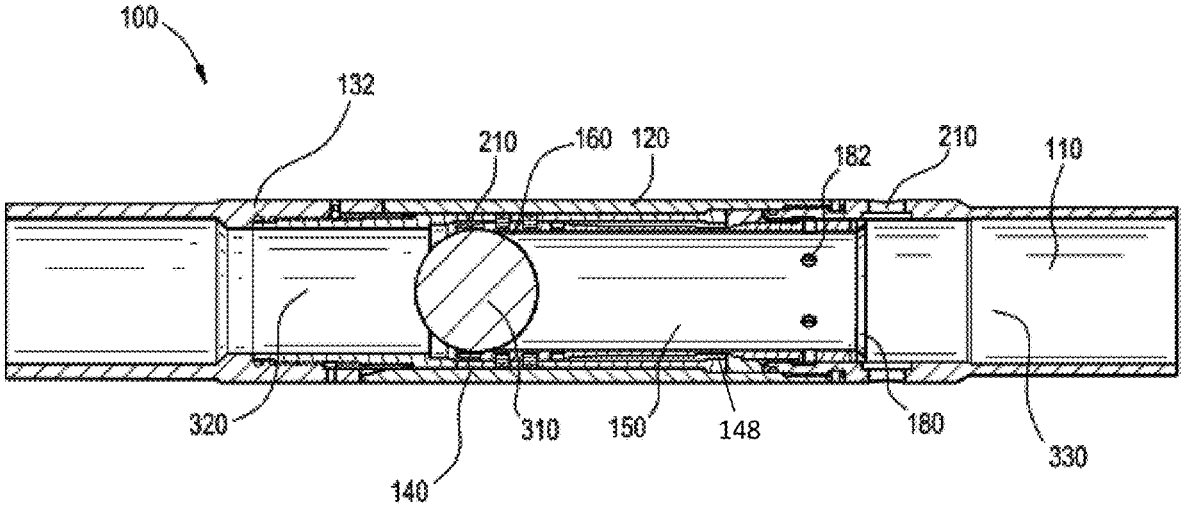
FIG. 2 depicts a tool, according to an embodiment.

FIG. 2 depicts tool 100, according to an embodiment. Elements depicted in FIG. 2 may be described above, and for the sake of brevity a further description of these matters is omitted.

As depicted in FIG. 2, responsive to burst disc 112 being ruptured or due to existence of a wet shoe, passageway 210 extending from an inner diameter of tool 100 to an annulus positioned outside of tool 100 may be exposed. This may allow for communication between the annulus and inner diameter of tool 100.

A ball 310 may be configured to sit on seat 152. Responsive to positioning ball 310 on seat 152, a first area 320 above ball 310 within the inner diameter of tool 100 may be isolated from a second area 330 positioned below ball 310 except through bypass 210.

Bypass 210 may be created within a space between the outer diameter of support sleeve 150 and the inner diameter of adjuster sleeve 120 and bottom sub-assembly. More so, the bypass 210 may be created responsive to shear pin 160 shearing, allowing support sleeve 150 to move down well.

Responsive to the pressure within the first area 320 increasing past a threshold, shear pin 160 may shear. This may decouple support sleeve 150 from adjuster sleeve 140 at the first location, allowing support sleeve 150 to move towards the distal end of tool 100.

When support sleeve 150 moves towards the distal end of tool 100, inner projection 148 may be positioned between first outcrop 154 and second outcrop 156. This may enable outer projection 146 to be positioned away from no-go 122.

Furthermore, when inner projection 148 is between first outcrop 154 and second outcrop 156, support sleeve 150 may be mechanically coupled to adjuster sleeve 140 at a second location, which is a different location than the first position of shear pin 160.

Figure 3:
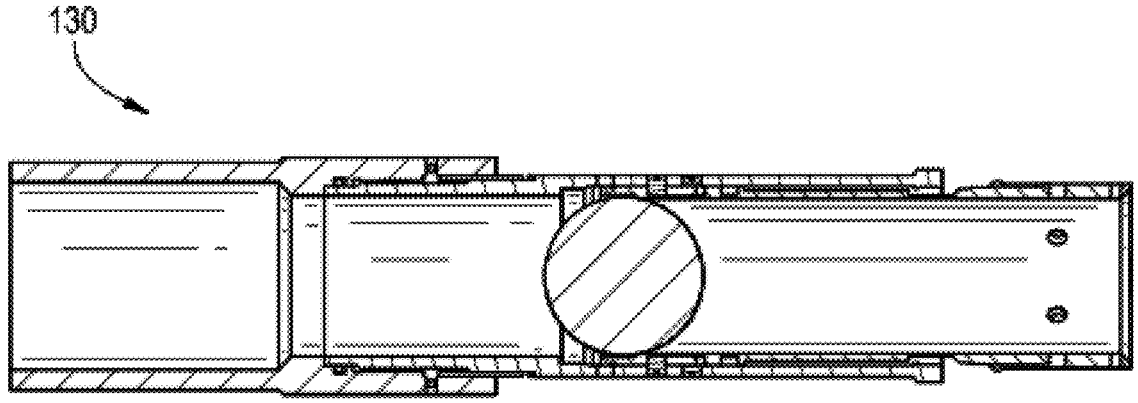
FIG. 3 depicts an upper sub-assembly according to an embodiment.

FIG. 3 depicts upper sub-assembly 130, according to an embodiment.

Elements depicted in FIG. 3 may be described above, and for the sake of brevity a further description of these matters is omitted.

Responsive to upper sub-assembly 130 being detached from housing 120 and bottom sub-assembly 110, upper sub-assembly 130 may be removed from a wellbore, while housing 120 and bottom sub-assembly remain in the wellbore.

Figure 4:
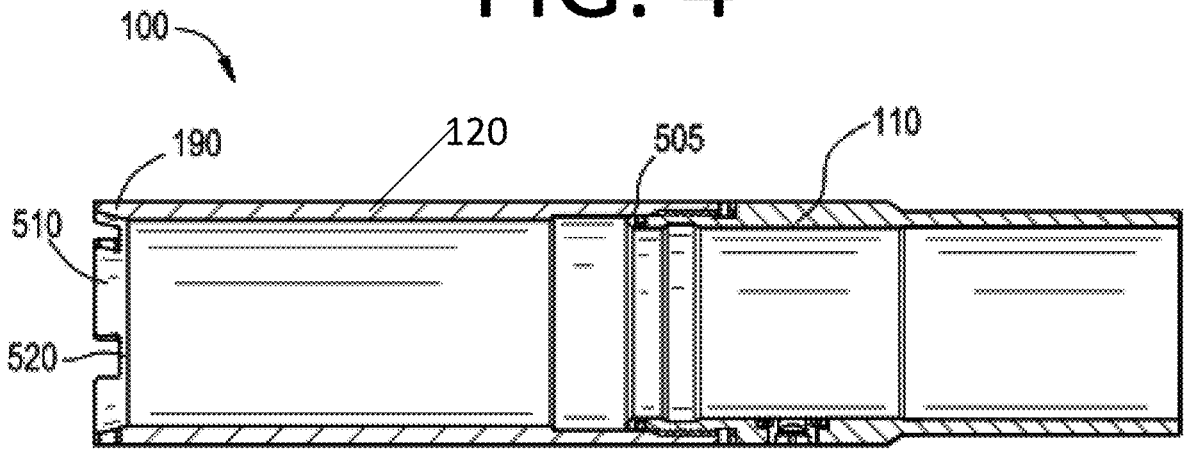
FIG. 4 depicts a bottom sub-assembly and housing, according to an embodiment.

FIG. 4 depicts tool 100 that is configured to remain downhole after upper sub-assembly 130 is disconnected from lower sub assembly 110, according to an embodiment. Elements depicted in FIG. 4 may be described above, and for the sake of brevity a further description of these matters is omitted.

After upper sub-assembly 130 receives an upward force or the casing getting downward force, upper-sub assembly 130 may become detached from housing 120 and bottom sub-assembly 110. This may enable portions of tool 100 to be separated and removed from a wellbore. Responsive to upper sub-assembly 130 being detached from housing 120 and bottom sub-assembly 110, only housing 120 and bottom sub-assembly 110 may remain in the wellbore. This may enable upper sub-assembly 130 to be removed from the wellbore. In other embodiment when support sleeve 150 is coupled with seal assembly 920 then a squeeze cement job can be carried out Furthermore, FIG. 4 depicts a beveled proximal end of housing 120, which included anti-rotational lock 190. Anti-rotational lock 190 includes a set of first fingers 510, and a set of first grooves 520. This first set of fingers and grooves may be configured to be interfaces with a second set of fingers and grooves on a distal end of the outer sidewall of the upper sub-assembly. Additionally, a proximal end of bottom sub-assembly 110 may include a beveled rim 505, edge, etc. This may allow for an easier insertion of various tubing, tools, etc. through the wellbore, while operating as a no-go to limit the downward movement of the support sleeve after it shears. In embodiments, rim 505 may be configured to be a ball seat, wherein a ball is configured to land on rim 505. By positioning the ball seat on the proximal end of bottom sub-assembly 110 an additional reduction of an inner diameter of tool 100 may not be required. In other embodiment, rim 505 may be duplicated near the beveled proximal end of housing 120, allowing another ball to be dropped further up.

Figure 5:
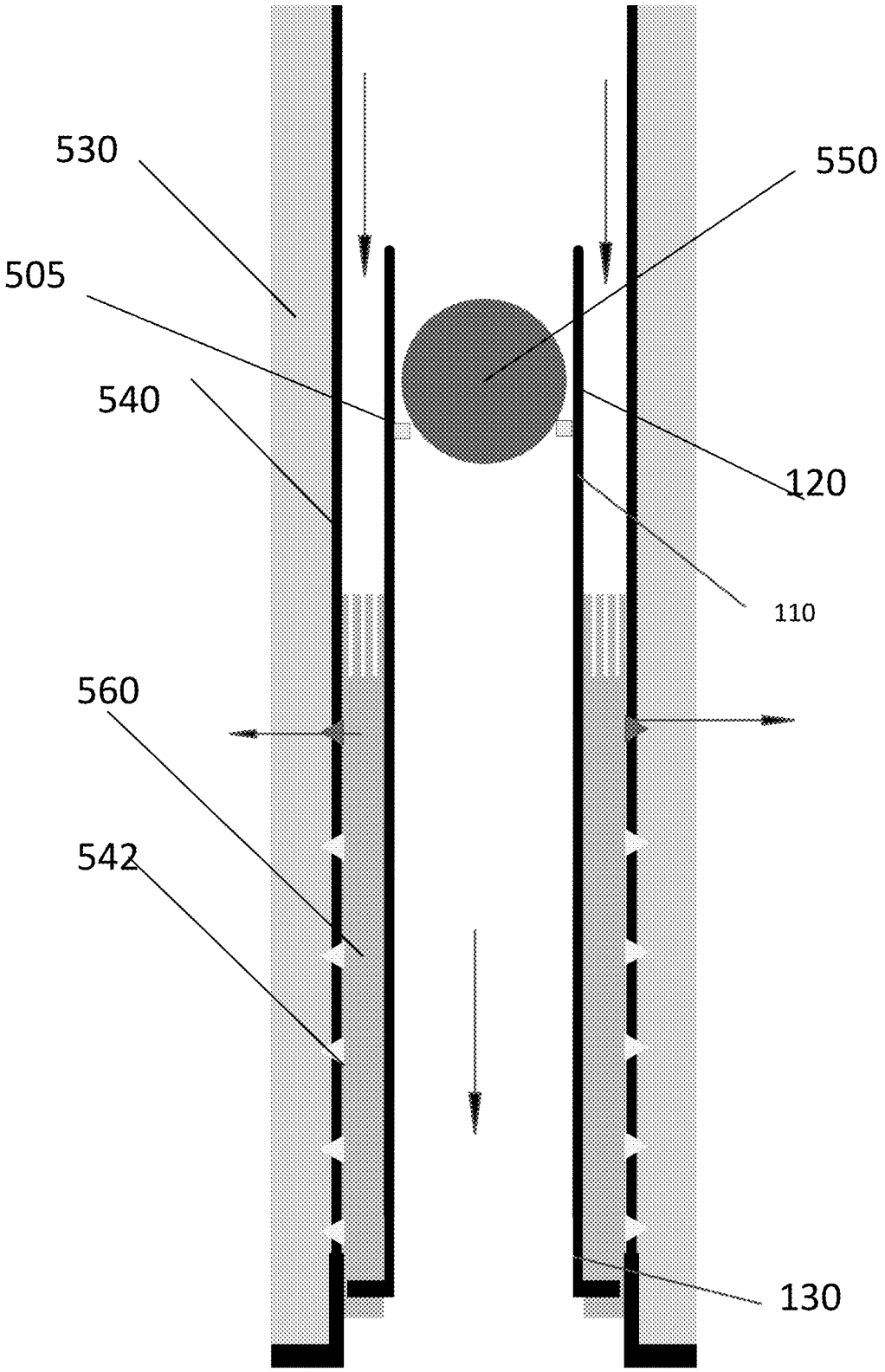
FIG. 5 depicts a bottom sub-assembly and housing, according to an embodiment.

FIG. 5 depicts housing 120 and bottom sub-assembly being positioned downhole after upper sub-assembly 130 is removed from the wellbore, wherein housing and bottom sub assembly 110 may be a unified, single piece element. Elements depicted in FIG. 5 may be described above, and for the sake of brevity a further description of these elements may be omitted.

When downhole tool 100 is run in hole as a unified element, wherein the downhole tool may be run in hole within a new hole with no casing or run in hole within a cased hole. In embodiments, the downhole may be run in hole in a previously cased 540 hole, wherein production associated with previously perforations 542 has decreased. The downhole tool may be run in hole to a desired depth, and be positioned adjacent to a casing shoe. Cement 560 may be pumped through an inner diameter of the downhole, exit out the bottom of the downhole, and return in an annulus positioned between an outer circumference of the downhole and the existing casing 540. Then, a wiper may be pumped downhole through the inner diameter of the downhole to sweep the pump cement out of the bottom of the downhole, wherein the wiper may be pumped to the casing shoe positioned at the bottom of the downhole, wherein the shoe may be an exit point of the downhole. Then, procedures as described above may be performed to disconnect the upper sub-assembly from housing 120 and bottom sub assembly 110, which may allow housing 120 and bottom sub-assembly 110 to remain downhole. As such, an upper surface of housing 120 may become a top piece of a casing liner downhole.

To test the new casing formed of housing 120 and bottom sub-assembly 110 and the new casing joints, pressure within the hole may be increased. This increase in pressure for the testing may indicate that the new casing formed of housing 120, bottom sub-assembly, new casing joints, and cement 560 is leaking. However, the location of the leak may be currently unknown, and may be located from behind the casing in an old perforation 560 or a leak at the casing shoe because casing wiper plug did not land properly.

A ball 550, object, etc. may be configured to be land on a profile 505, indentation, etc. to be positioned on an inner diameter or at the proximal end of housing 120 or bottom sub-assembly 110. In embodiments, ball 550 may be configured to be pumped from surface or run on a wireline, slick line, coiled tubing, conveyed via tubing. When ball 550 is positioned on profile 505, a first chamber positioned above ball 550 may be isolated from a second chamber positioned below ball 550. In embodiments, ball 550 may be a dissolvable ball, composite ball, magnetic ball, etc. When ball 550 is positioned on profile 505, pressure within the first chamber above ball 550 within may be increased. If pressure is leaking above ball 550, then it may be determined that backside between cement 560 and existing perforations 542 is leaking and a squeeze job is required, wherein additional cement is positioned in the annulus between housing 120 and existing casing 540. If pressure is not leaking above ball 550, then it may be determined that pressure is leaking in the second chamber there is a wet shoe, which may be remediated.

Due to ball 550 being a dissolvable ball, no additional intervention is required to remove ball 550. Ball 550 may gradually decrease in size and pass through tool the downhole.

Figure 6:
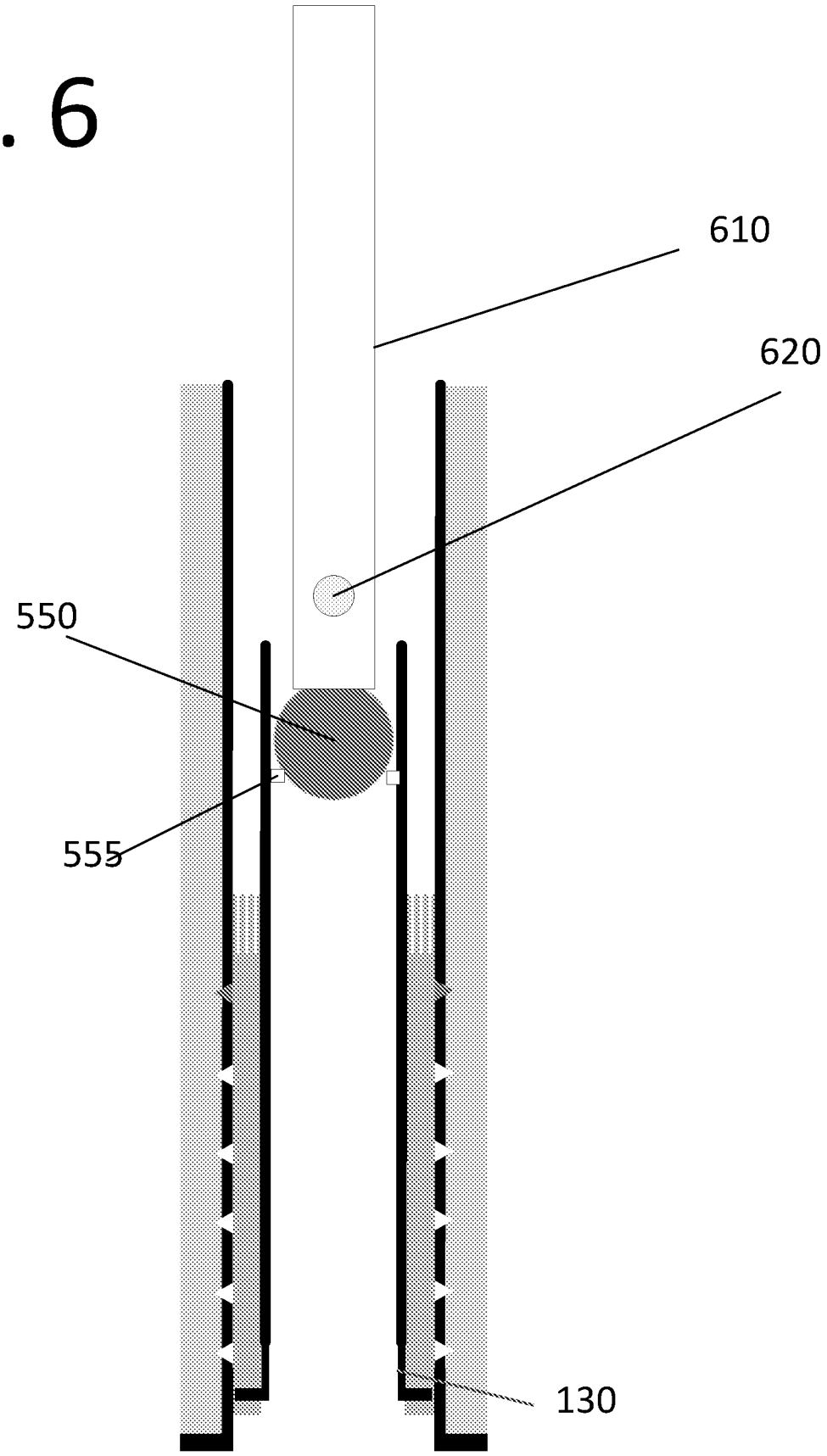
FIG. 6 depicts an interventionless tool for testing a new casing and performing a squeeze job in a single run, according to an embodiment.

FIG. 6 depicts housing 120 and bottom sub-assembly 110 being positioned downhole after upper sub-assembly 130 is removed from the wellbore. Elements depicted in FIG. 6 may be described above, and for the sake of brevity a further description of these elements may be omitted.

As depicted in FIG. 6, ball 550 may be run in hole on a rod 610. Rod 610 may be a hollow rod or a sliding sleeve that open on demand, which may be coupled to a stick pipe, coiled tubing, or any other conveying mechanism. In embodiments, a distal portion of rod 610 may include ports 620, and rod 610 may have a closed distal end that is covered by and coupled to ball 550. Responsive to ball 550 landing on profile 505, to isolate the first chamber from the second chamber, cement may be pumped through rod 610 and be emitted/displaced out of rod through ports 620. The emitted cement may be emitted from ports 620 at a location close to an opening of the annulus between the downhole and existing casing 540, i.e.: liner top. This may enable the squeeze job to be more effectively and efficiently performed directly at the linear top formed by the downhole. After the squeeze job, rod 610 and ball 550 may be pulled out of hole. This allows a squeeze job to be performed directly after testing without having to position complex packers across an inner diameter of the downhole, which would require multiple trips, milling, and/or tools. In other embodiments, when squeeze cement may be decided prior to any casing testing, circulating port 112 in top sub and the disconnect ball for release sleeve 140 and support sleeve 150 may be used to accomplish this operation when the support sleeve 150 is coupled with seal assembly 920 at its distal end.

Figure 7:
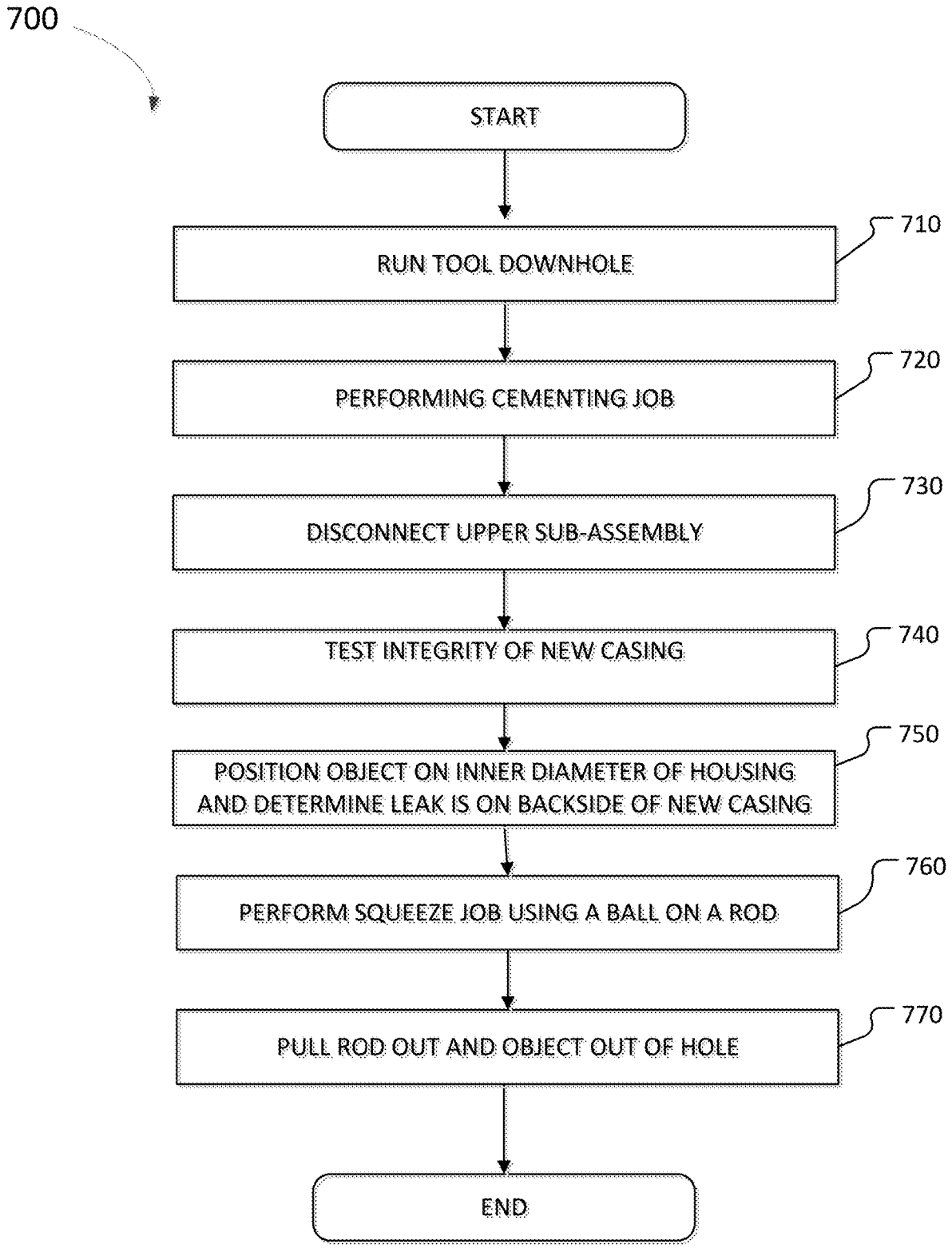
FIG. 7 depicts an interventionless method for detaching an upper sub-assembly from a bottom sub-assembly, according to an embodiment.

FIG. 7 depicts a method 700 for an interventionless system for testing casing, according to an embodiment. The operations of method 700 presented below are intended to be illustrative. In some embodiments, method 700 may be accomplished with one or more additional operations not described, and/or without one or more of the operations discussed. Additionally, the order in which the operations of method 700 are illustrated in FIG. 7 and described below is not intended to be limiting. Furthermore, the operations of method 700 may be repeated for subsequent valves or zones in a well.

At operation 710, a tool with housing, an upper sub-assembly, and bottom sub-assembly may be positioned within a wellbore on a shoe.

At operation 720, a conventional casing cement job may be performed. The cement job may be performed by pumping cement through the tool, and having the cement return towards a surface in an annulus between the tool and a wellbore wall or existing casing.

At operation 730, an upper sub-assembly may be disconnected from a lower sub-assembly and housing. In embodiments, the upper sub-assembly may be disconnected by positioning a ball on a support sleeve of the upper sub-assembly. The ball to isolate an area above the ball from an area above the ball. Then, pressure in the area above the ball within the tool may increase. Responsive to increasing the pressure above the ball within the tool, a shear pin coupling the support sleeve to an adjuster sleeve may shear. The pressure may cause the support sleeve to move towards the distal end of the tool while the adjuster sleeve remains in place. When the support sleeve moves, a distal end of the adjuster sleeve may no longer be aligned with a first outcrop on the support sleeve. This may cause the distal end of the adjuster sleeve to become disengaged with a stop within the casing, and move towards a central axis of the tool. Next, the upper sub-assembly may be mechanically pulled towards proximal end of tool while the housing and lower sub-assembly remain downhole to provide new casing.

At operation 740, the integrity of the new casing, cement, and existing perforations within the old casing may be tested by increasing pressure downhole. The testing of the casing and cement may indicate that there is a leak.

At operation 750, a ball on a rod may be positioned downhole and land on a profile positioned on an inner circumference of the housing. This may separate a backside of the casing from the casing shoe, such that the backside of the casing may be tested independently from the shoe. Then pressure above the dissolvable ball may be increased to determine that there is a leak on the backside of the casing.

At operation 760, a squeeze job may be performed on the backside of the casing via ports positioned through the rod, with the ball attached to the bottom of the rod.

At operation 770, the rod and the ball may be pulled out of hole. Accordingly, the new casing may be tested and treated in a single run without positioning any new tools downhole.

Figure 8:
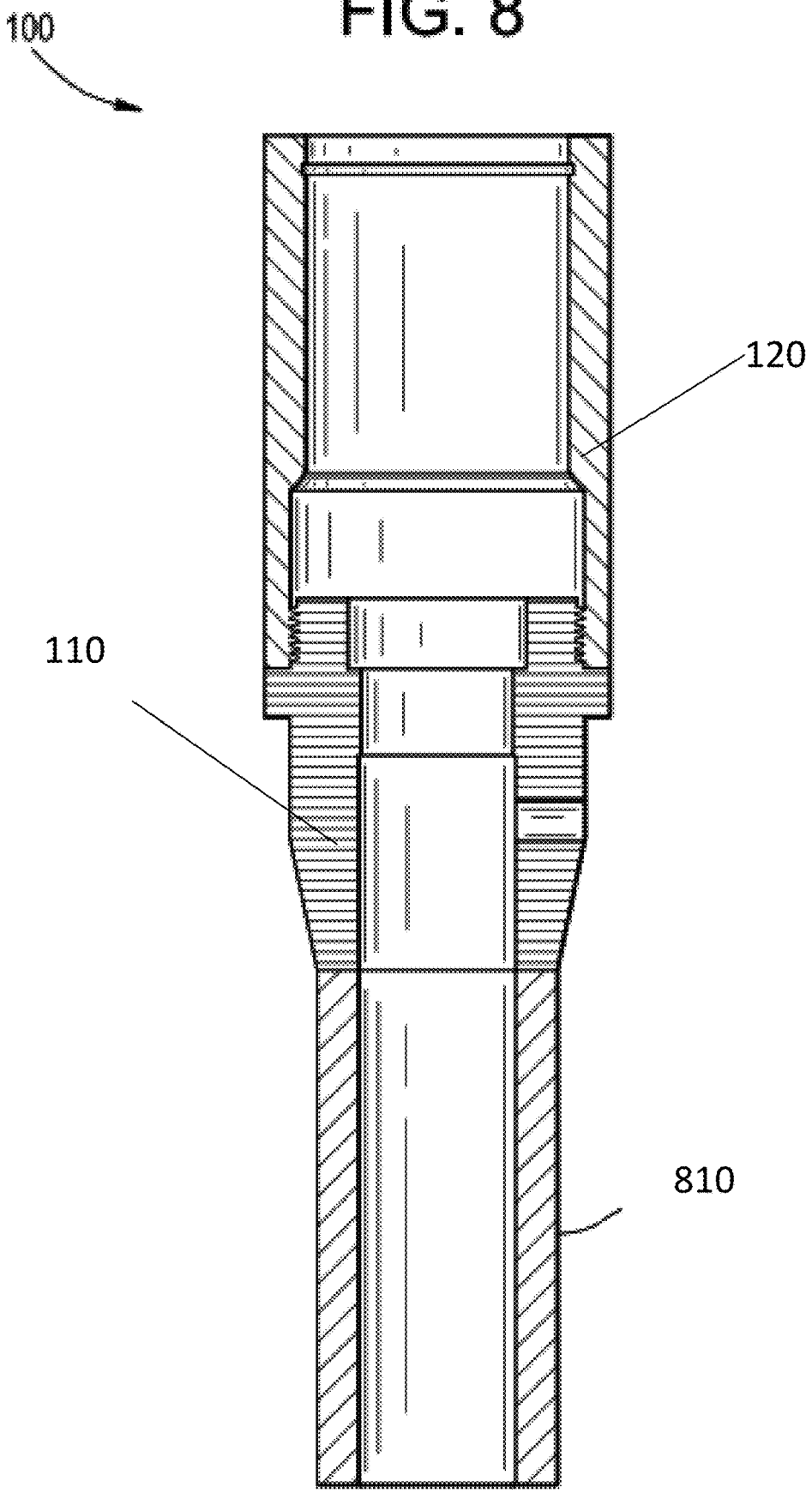
FIG. 8 depicts a tool, according to an embodiment.
Figure 9:
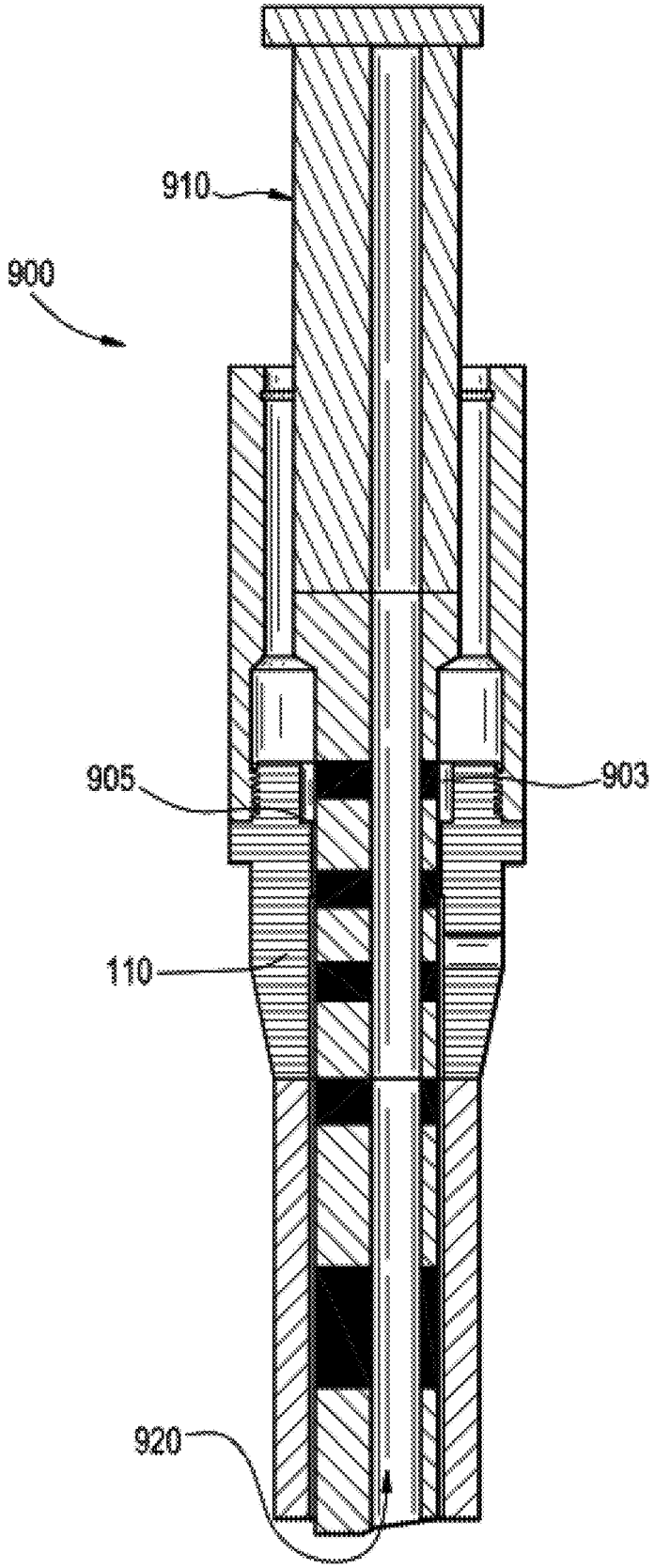
FIG. 9 depicts a tool, according to an embodiment.

FIGS. 8 and 9 depict a tool 100, according to an embodiment. Elements depicted in FIGS. 8 and 9 may be described above, and for the sake of brevity a further description of these matters is omitted.

As depicted in FIG. 8, a seal bore 810 may be positioned on an end of bottom sub-assembly 110. As depicted in FIG. 8, this may allow bottom sub-assembly 110 to become an integral and permanent part of casing already deployed downhole. In embodiments, seal bore 810 may have a smaller diameter than that of housing 120, such that seal bore 810 may be inserted on or within deployed casing to have outer diameter of the casing that is substantially similar to that of housing 120 when seal bore 810 is positioned within the existing, already deployed, casing. As such, bottom sub-assembly 110 and housing 120 may form a top of a casing liner with a casing with a substantially similar outer diameter with that of the existing casing.

As depicted in FIG. 9, responsive to upper sub-assembly 130 being removed from the wellbore, production tubing 910 and a seal assembly 920 may be inserted through the tool 100 and seal bore 810. Utilizing the beveled edges, rims, etc. 903, 905 positioned on the inner diameter of bottom sub-assembly 110 production tubing and seal assembly 920 may be more efficiently and easily positioned within tool 100. In other embodiments, seal assembly 920 may be connected to the support sleeve 150 and used for cement squeeze purposes.

Figure 10:
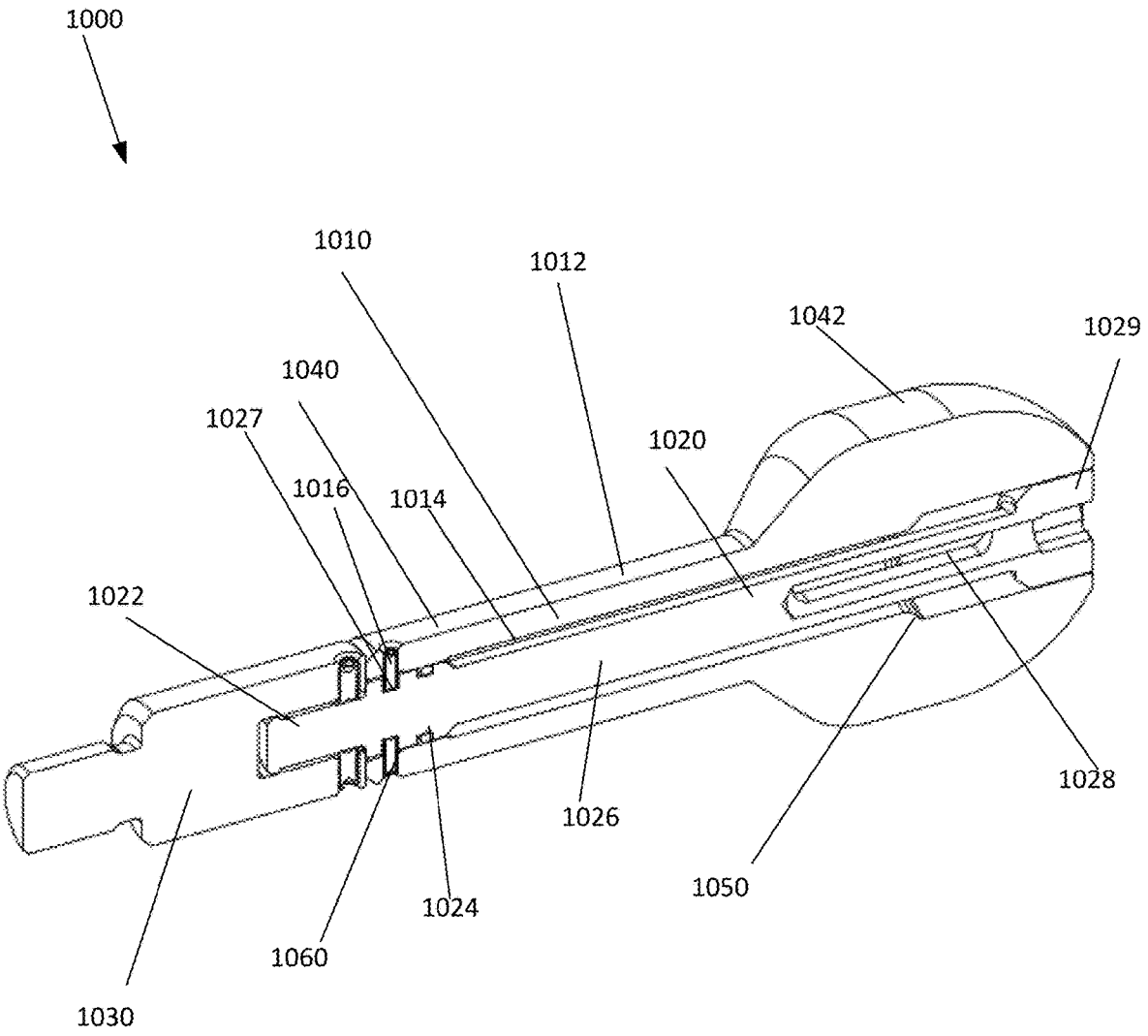
FIG. 10 depicts an object run in hole on a rod in a first position, according to an embodiment.
Figure 11:
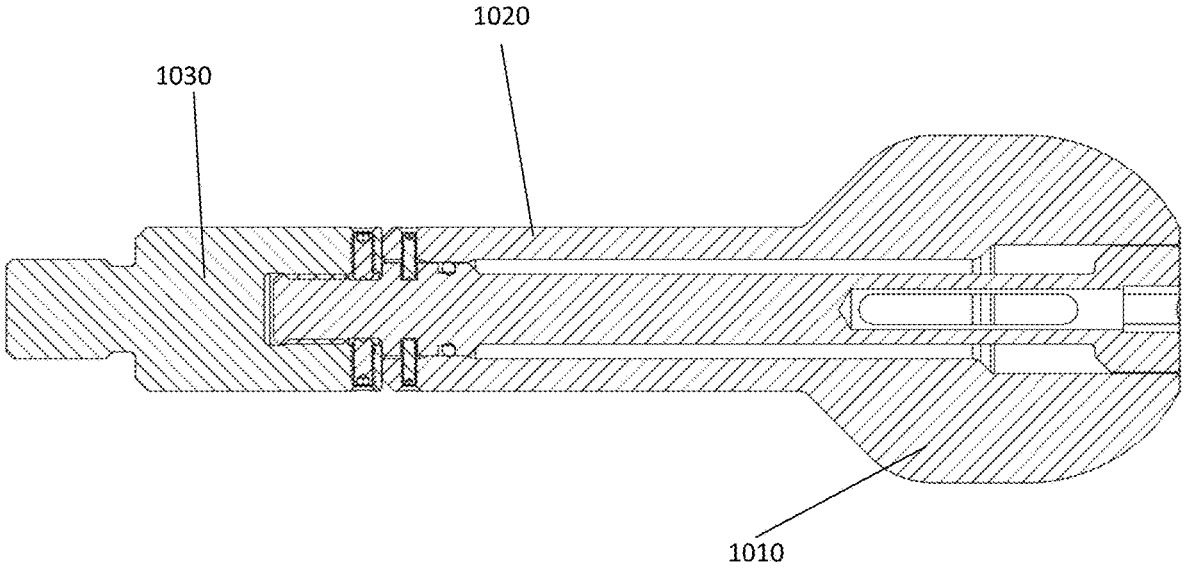
FIG. 11 depicts an object run in hole on a rod in a first position, according to an embodiment.

FIGS. 10 and 11 depict a downhole tool 1000 configured to be run in hole to isolate a first area from a second area. Situations may occur where a pressure differential across downhole tool 1000 is substantial, which makes it difficult to pull downhole tool 1000 out of a well. As such, it is desirable to equalize a pressure between the first area and second area through downhole tool 100. Downhole tool 100 includes an outer housing 1010, temporary coupling mechanism 1060, inner mandrel 1020, and rod 1030.

Outer housing 1010 may include a shaft 1012, object 1042, and passageway 1014.

The shaft 1012 may extend from a first end of the outer housing 1010 towards the second end of the outer housing 1010. In embodiments, the shaft may have a first outer diameter. Shaft 1012 may be configured to create space between the first end of outer housing 1010 and object 1042.

Object 1042 may be positioned on a second end of the outer housing 1010 or any location between the first end and second end of the outer housing 1042. Object 1042 may have a second outer diameter that is larger than the first outer diameter. Object 1042 may be configured to form a seal between an outer profile of object 1042 and a seat, casing, or any other element positioned adjacent to the outer profile of outer housing 1010, the object 1042 may have the shape of a ball or any other shape. In embodiments, the outer profile of object 1042 may include seal stack that are formed of a set separate seals that when brought together form a complete packing assembly. When object 1042 is positioned on a seat or other location, communication between the outer surface of the object 1042 and the seat may be restricted. In further embodiments, object 1042 may be formed of a dissolvable material, which may reduce a size of across the outer diameter of the object over time. Accordingly, over time the second diameter associated with object 1042 may reduce in size to be similar to the first diameter of shaft 1012.

Passageway 1014 may be a hollow passageway extending within a body of the outer housing 1010 from the first end to the second end of the outer housing 1014. Passageway 1014 may include a first groove 1016 and a no-go 1050. The first groove 1016 may be configured to extend from an inner surface of the passageway 1014 to the outer surface of the outer housing 1010. This may allow a first portion of the temporary coupling mechanism 1060 to be inserted into the first groove 1016.

The no-go 1050 may be a ledge that is configured to restrict movement of the inner mandrel 1020 in a first direction. In embodiments, where inner mandrel 1020 is position in the first position then projection 1029 of inner mandrel 1020 may be positioned downhole from no-go 1050. However, when inner mandrel 1020 is in the second position, projection 1029 may travel in a first direction up hole and be positioned adjacent to no-go 1050. The ledge may reduce a diameter across the passageway 1014, such that a projection 1029 positioned on an outer surface of the inner mandrel 1020 may not move past the ledge. Accordingly, the passageway 1014 may have varying diameters, wherein a diameter of the passageway 1014 proximate to the second end is larger in size than the diameter of the passageway proximate to the first end of the passageway. Furthermore, the ledge may be configured to receive forces from the inner mandrel 1020, such that when the inner mandrel is pulled out of the hole the outer housing 1010 is simultaneously pulled out of the hole.

Temporary coupling mechanism 1060 may be a shear pin, shear screw, or any other element that is configured to temporarily couple outer housing 1010 and inner mandrel 1020 at a first location. Temporary coupling mechanism 1060 may have a first end that is configured to be inserted into the first groove 1016 and a second end that is configured to be inserted into a second groove 1027 within the inner mandrel 1020. Responsive to applying a force to the temporary coupling mechanism 1060 that is greater than a force threshold, the temporary coupling mechanism 1060 may break. This may allow the inner mandrel 1020 to move relative to a static outer housing 1010. In embodiments, the force threshold to break the temporary coupling mechanism 1060 may be less than a threshold associated with disengaging the upper-sub assembly 130 and the inner mandrel 120.

Inner mandrel 1020 may be configured to move along an axis to selectively restrict and allow communication through passageway 1014. Inner mandrel 1020 may include a proximal end 1022, second groove 1027, seal 1024, shaft 1026, bypass 1028, and projection 1029.

Proximal end 1022 of inner mandrel 1020 may be configured to be inserted into rod 1030. This may allow rod 1030 to translate forces to inner mandrel 1020 to run inner mandrel 1020 downhole in a second direction, then shear temporary coupling mechanism 1060, and move inner mandrel 1020 up hole in a first direction. In embodiments, the proximal end 1022 may be configured to be permanently or temporarily coupled to rod 1030 or selectively coupled to rod 1030 via secondary temporary coupling mechanisms, which may shear at a second pressure threshold that is larger than the pressure threshold needed to shear the temporary coupling mechanism 1060.

Second groove 1027 may extend from an outer surface of inner mandrel 1020 towards a central axis of inner mandrel 1020. Second groove 1027 may be configured to receive a second portion of temporary coupling mechanism 1060, which may temporarily couple inner mandrel 1020 and outer housing 1010 at the first location.

Seal 1024 may be a device that is configured to be positioned against a surface defining passageway 1014 to seal passageway 1014 when inner mandrel 1020 is coupled to outer housing 1010 in the first position. In embodiments, the seal may be an O-ring, metal to metal seal, or any other type of sealing mechanism. Responsive to shearing the temporary coupling mechanism 1060 and moving inner mandrel 1020 to be in a second position, seal 1024 may not be positioned within the passageway 1014. This may allow communication of fluid through an annulus 1300 (shown in FIG. 13) between an outer surface of the inner mandrel 1020 and the surface defining the passageway 1014.

Shaft 1022 may extend between the seal 1024 and the distal end of the inner mandrel 1020, the shaft 1022 may have an outer diameter that is smaller than the diameter across the passageway 1014. This may allow annulus 1300 to be formed between the shaft 1022 and the passageway 1014.

Bypass 1028 may include a conduit and ports. The conduit may extend through a body of the inner mandrel from the distalmost end of the inner mandrel 1020. The ports may extend from an outer surface of shaft 1022 to the conduit. Bypass 1028 may allow fluid to flow between within annulus 1300, through the ports, and out of the conduit to an area below the object 1042. However, when inner mandrel 1020 is in the first position, an upper end of bypass may be sealed via seal 1024.

The distal end of the inner mandrel may be configured to be positioned within the passageway between no go 1050 and the second end of the outer housing 1010. The distal end may have a projection 1029 with an outer diameter that is substantially the same as the diameter of passageway 1050 between no go 1050 and the second end of the outer housing 1010. This may enable the distal end of the inner mandrel 1210 to form a seal between the outer surface of the distal end and the surface defining the passageway 1014, which may force communication through bypass 1028. In embodiments, when the inner mandrel 1020 is in the first position, the distal end of the inner mandrel 1020 may be flush with the second end of the outer housing 1010. Responsive to the temporary coupling mechanism 1060 shearing and the inner mandrel 1020 moving in the first direction, while the outer housing 1010 remains static, the projection 1029 may be positioned adjacent to the no-go 1050. The movement of the relative movement of inner mandrel 1020 with respect to the outer housing 1010 may be restricted based on the projection 1029 being positioned against the no-go 1050. This may force the outer housing 1010 and the inner mandrel 1020 to be pulled out of the hole together.

Rod 1030 may be mounted on wireline, slick line, stick pipe or coiled tubing or any other conveying system. It may be a shaft that is configured to receive forces and translate the forces to the inner mandrel 1020 while connecting the inner mandrel 1020 to the conveying system. Rod 130 may include an orifice, cavity, etc. that is configured to receive the proximal end of the inner mandrel 1020. A lower surface of the rod 1030 may be configured to be positioned adjacent to the first end of the outer housing 1010 when the inner mandrel 1020 is in the first position. By abutting the lower surface of rod 1030 against a first end of outer housing 1010, outer housing 1010 may not move in a second direction relative to rod 1030.

Figure 12:
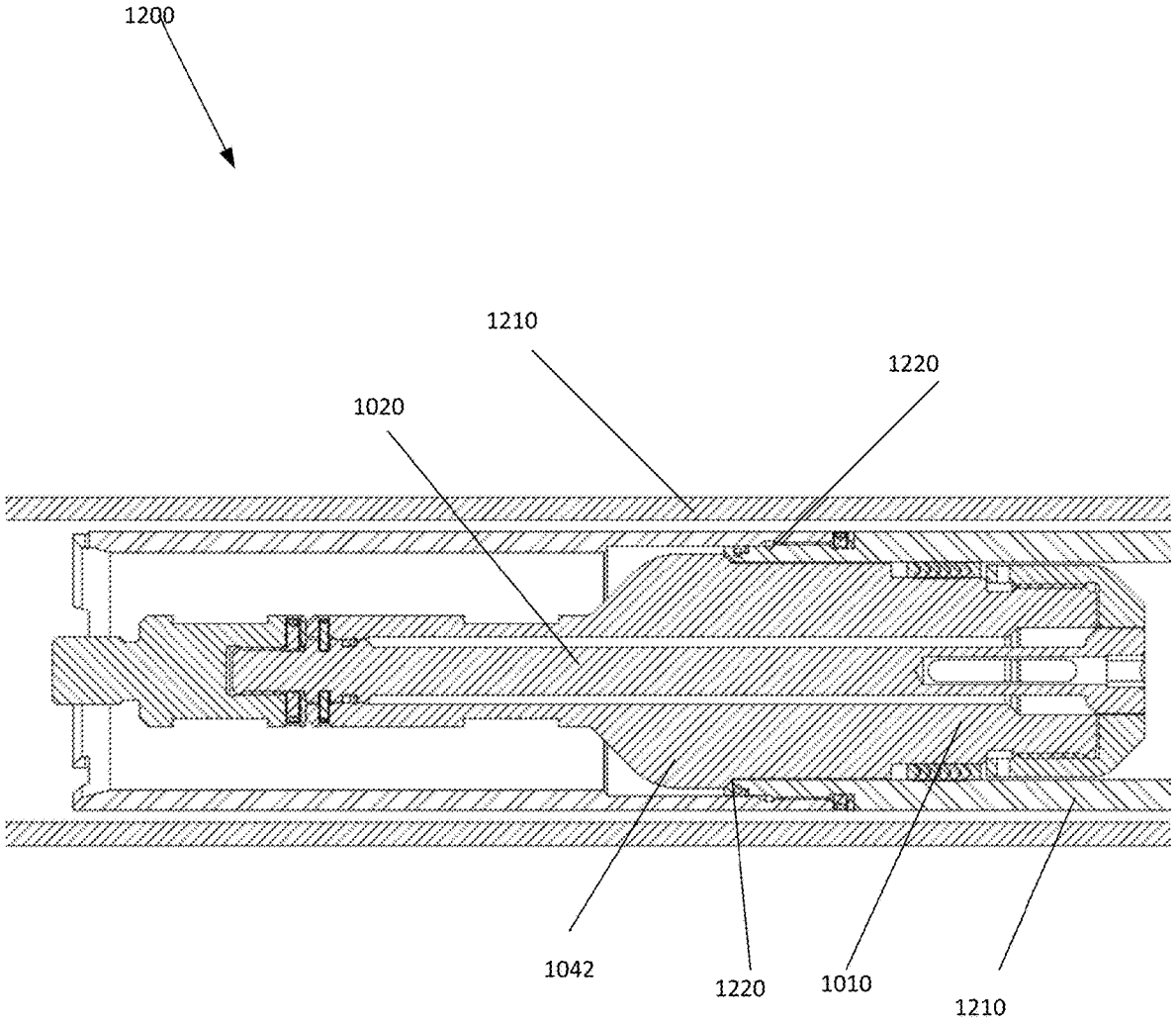
FIG. 12 depicts an object run in hole on a rod landed on a bottom sub assembly, according to an embodiment.

FIG. 12 depicts downhole tool 1200 with an object run in hole on a rod landing on a seat 1220 associated with a bottom sub assembly, which may be positioned within casing 1210. Elements depicted in FIG. 12 may be described above, and for the sake of brevity a further description of these elements is omitted.

As depicted in FIG. 12, downhole tool 1200 may include a standing valve 1230. The standing valve 1230 may be configured to seal in the inner diameter of a bottom sub assembly 1210. Responsive to landing object 1042 on a seat 1220 for bottom sub assembly 1210, an upward force may be created on inner mandrel 1020, which may allow bypass 1042 to be exposed through the annulus 1300

Figure 13:
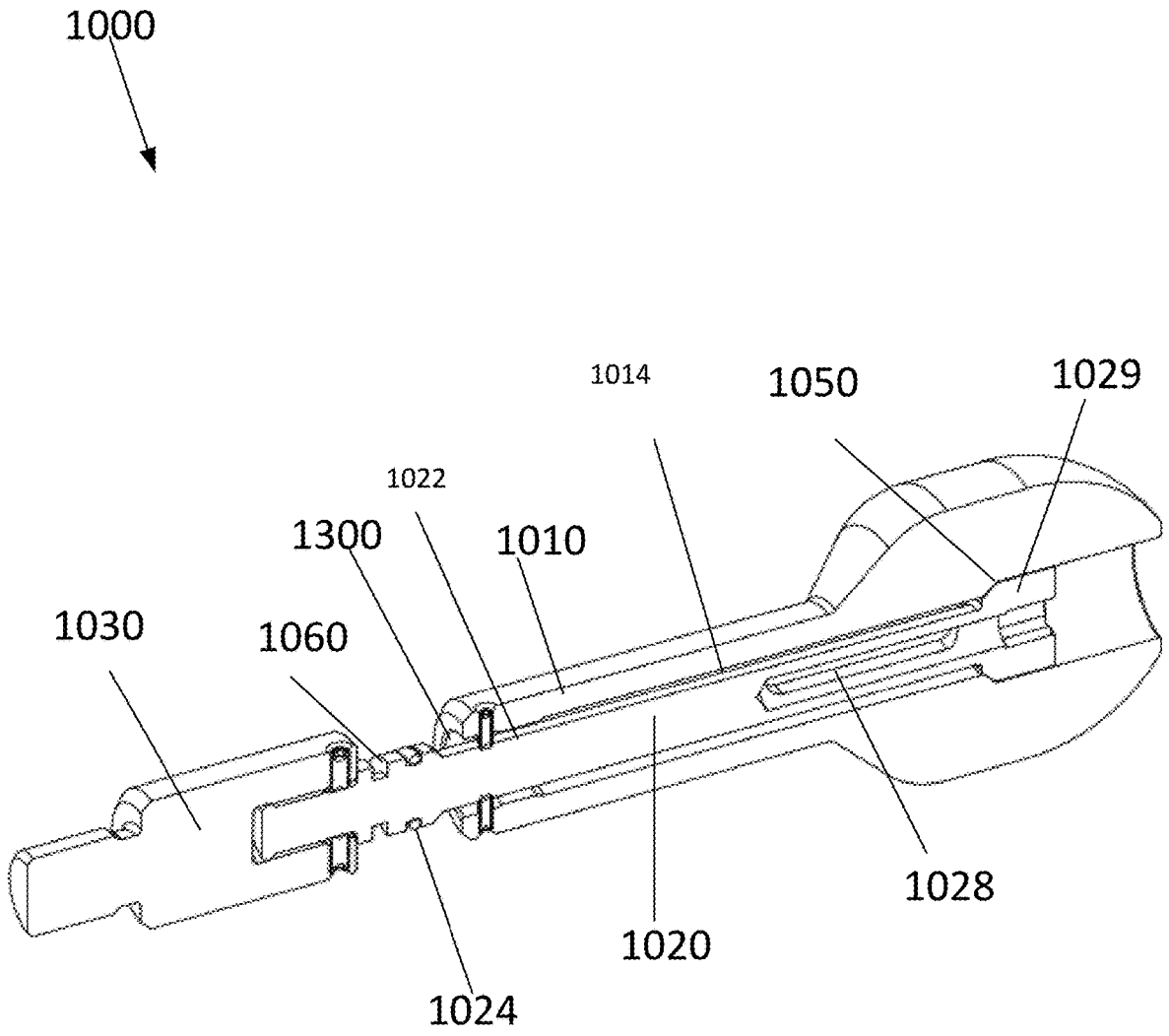
FIG. 13 depicts an object on a rod in a second position, according to an embodiment.
Figure 14:
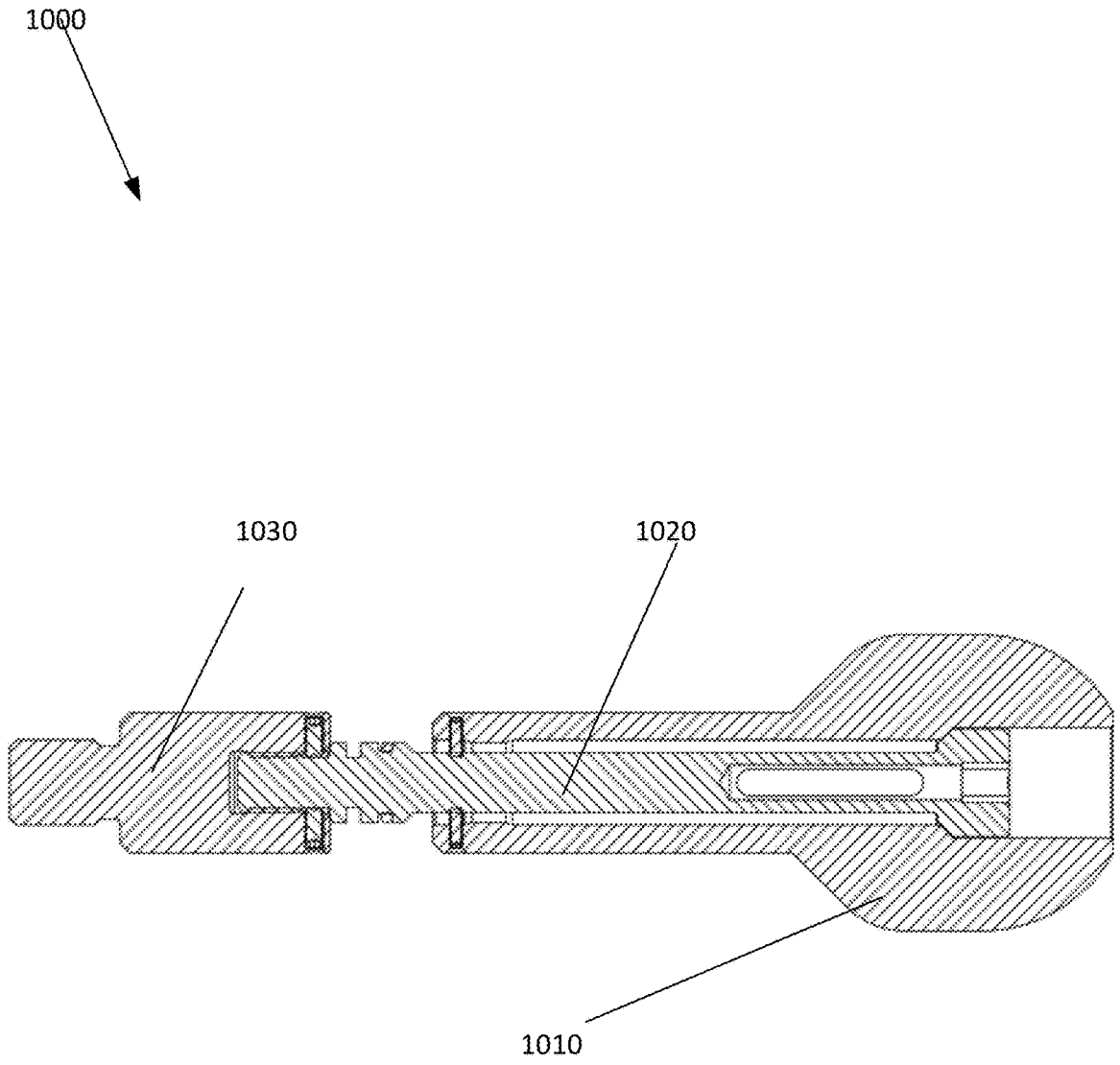
FIG. 14 depicts an object on a rod in a second position, according to an embodiment.

FIGS. 13 and 14 depicts a downhole tool in a second position, according to an embodiment. Elements depicted in FIGS. 13 and 14 may be described above. For the sake of brevity an additional description of these elements is omitted.

As depicted in FIGS. 13 and 14, responsive to rod 1030 receiving an upward force, and translating these forces to inner mandrel 1020, coupling mechanism 1060 may shear. This may allow inner mandrel 1020 to move in a first direction until projection 1029 is position adjacent to no-go 1050. Due to the movement of inner mandrel 1020, seal 1024 may no longer be positioned within passageway 1014, which may expose annulus 1300. Accordingly, fluid may flow through bypass 1028 to equalize across object 1042.

In embodiments, annulus 1300 may extend from the first end of outer housing 1010 to projection 1029 positioned on the distalmost end of inner mandrel 1020. This may allow the annulus to extend past the ports associated with bypass 1042.

Figure 15:
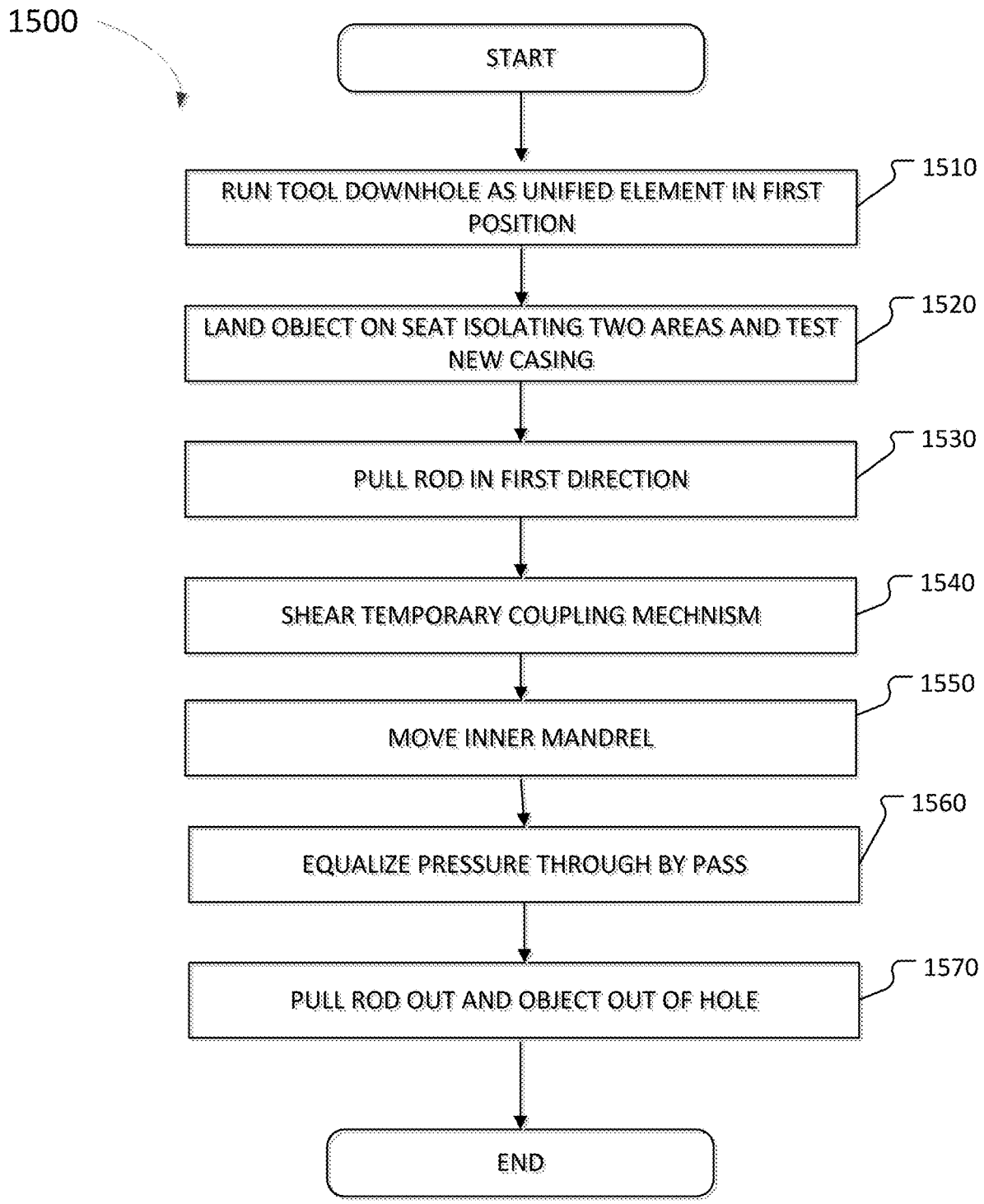
FIG. 15 depicts a method of utilizing an object on a rod, according to an embodiment.

FIG. 15 depicts a method 1500 for running an object on a rod, according to an embodiment. The operations of method 1500 presented below are intended to be illustrative. In some embodiments, method 1500 may be accomplished with one or more additional operations not described, and/or without one or more of the operations discussed. Additionally, the order in which the operations of method 1500 are illustrated in FIG. 15 and described below is not intended to be limiting.

At operation 1510, a downhole tool may be run in hole as a unified element in a first position.

At operation 1520, an object of the downhole tool may land on a seat or extend across a casing to form a seal between an outer surface of the object and an inner surface of the seat. Responsive to positioning the object on the seat, a seal may be formed from a first area below the object and a second area above the object.

At operation 1530, a rod of the downhole tool may be pulled in a first direction.

The forces associated with pulling the rod may be translated to an inner mandrel.

At operation 1540, a temporary coupling mechanism coupling the inner mandrel and the object may be sheared based on the forces translated from the rod to the inner mandrel. In embodiments, the forces may be greater than a shear threshold associated with the temporary coupling mechanism.

At operation 1550, the inner mandrel may move in the first direction while the object remains static. In embodiments, the inner mandrel may move until a projection positioned on an outer surface of the inner mandrel is positioned adjacent to a no-go positioned within a body of the object. When the inner mandrel moves in the first direction, a seal initially positioned within the body of the object may be positioned outside of the body, which may expose an annulus positioned between the outer surface of the inner mandrel and the body of the object.

At operation 1560, fluid may flow through the annulus and a bypass within the inner mandrel. This may allow pressure to equalize between the first area and the second area.

At operation 1570, the object, inner mandrel, and rod may be pulled out of hole together.

Figure 16:
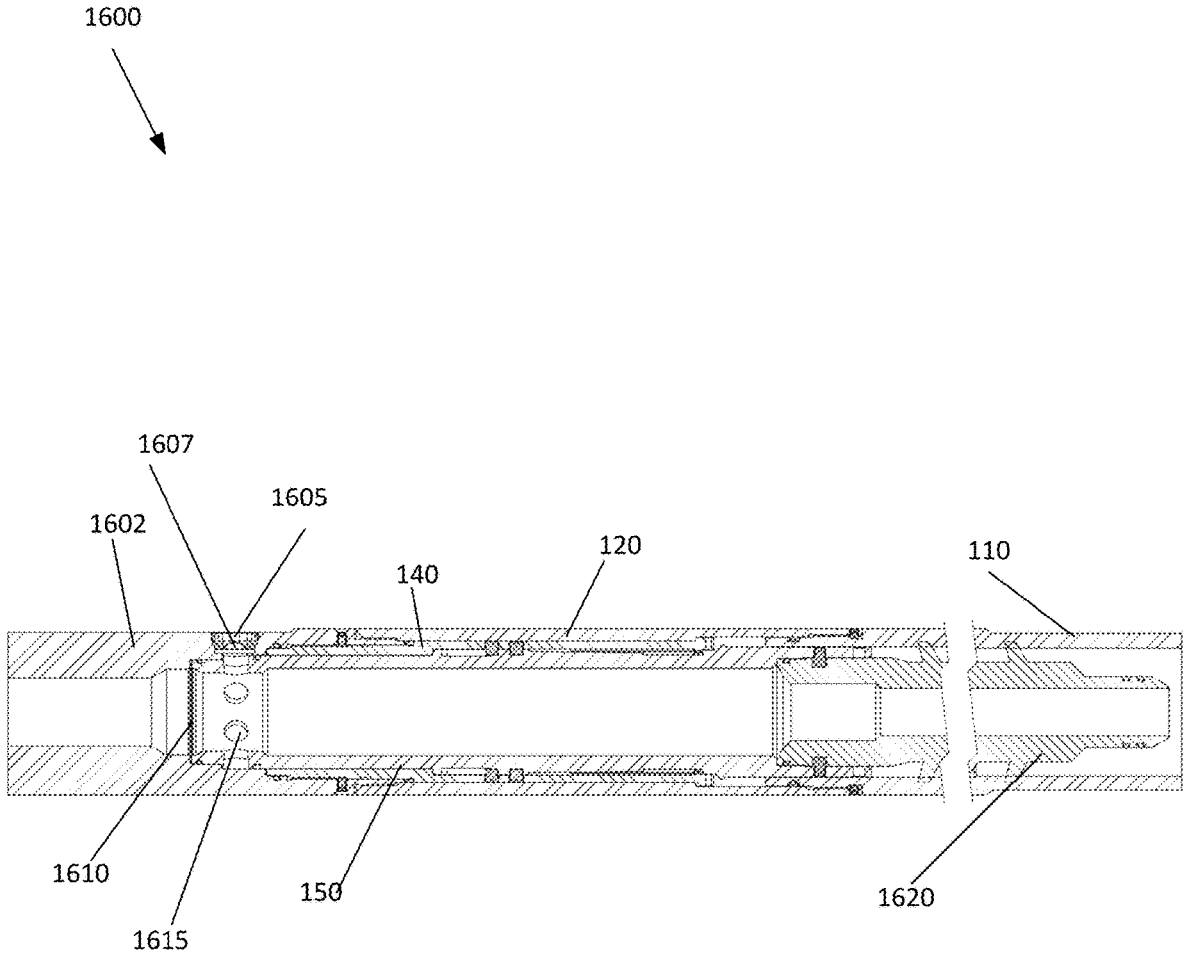
FIG. 16 depicts a tool, according to an embodiment.

FIG. 16 depicts a detachable tool 1600 for use in a wellbore, according to an embodiment. Elements in FIG. 16 may be described above, and for the sake of brevity a further description of these elements may be omitted. As depicted in FIG. 16, detachable tool 1600 may include a bottom sub-assembly 110, housing 120, and upper-sub assembly 1602.

Situations may occur where detachable tool 1600 is positioned within a depleted well, and it may be known ahead of time before detachable tool 1600 is positioned downhole, that cement pumped ahead of the detachable tool may not return all the way to a surface. Therefore, it may be desired for detachable tool 1600 to be able to pump cement at a location above a wiper plug 1620.

Upper sub assembly 1602 may include a passageway 1605 that is initially blocked by a rupture disc 1607. After an initial cementing operation, rupture disc 1607 may be ruptured, and passageway 1605 may be exposed.

Next, a ball or object may land on a proximal end 1610 of support sleeve 150.

This may allow pressure to increase above the object, which may move proximal end 1610 below passageway 1605, and form a seal within a body of detachable tool 1600.

After the object is positioned on proximal end 1610 and proximal end 1610 is positioned below passageway 1605, additional cement may be pumped through the body of detachable tool 1600 and circulated through passageway 1605 directly into an annulus outside of upper-sub assembly 1602 and bullhead the entire well, allowing cement to be squeezed on the backside through passageway 1605.

Figure 17:
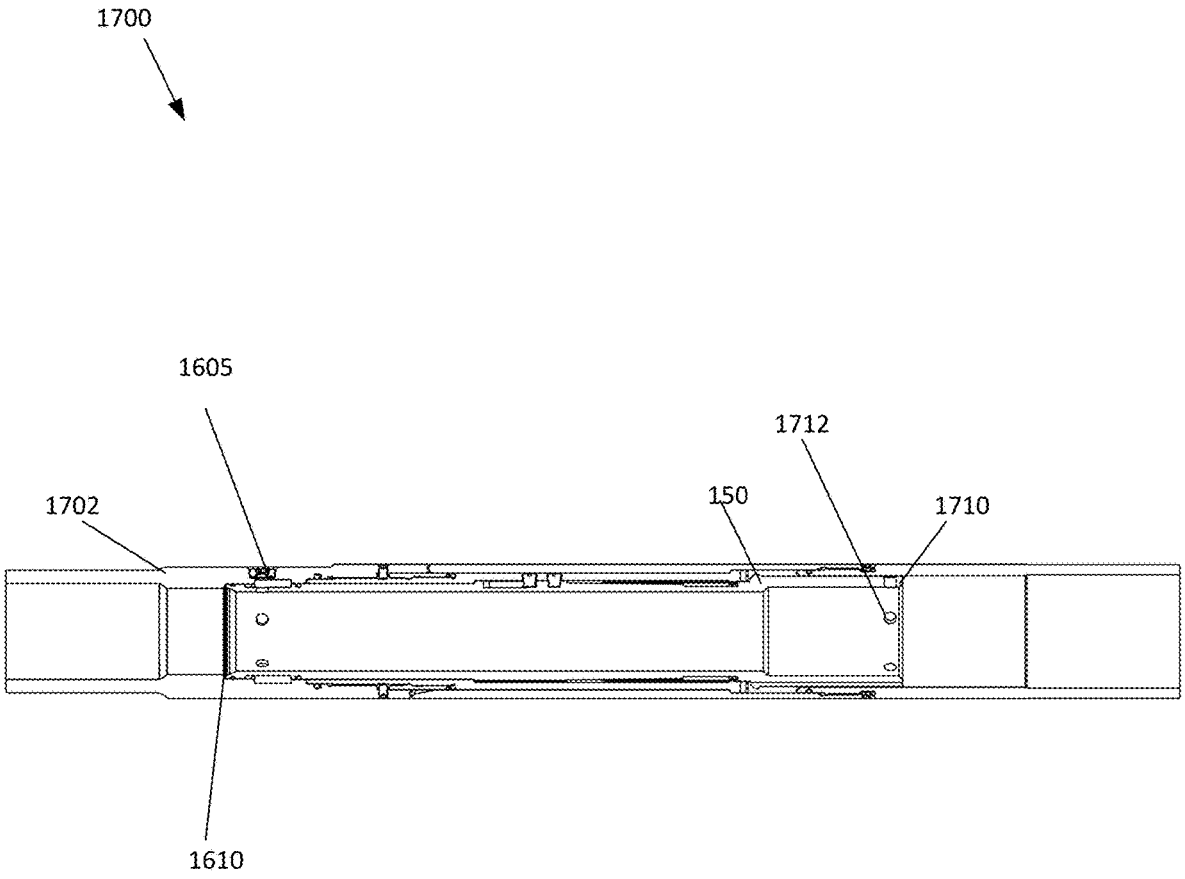
FIG. 17 depicts a tool, according to an embodiment.

FIG. 17 depicts a detachable tool 1700 for use in a wellbore, according to an embodiment. Elements in FIG. 17 may be described above, and for the sake of brevity a further description of these elements may be omitted. As depicted in FIG. 17, detachable tool 1700 may include a bottom sub-assembly 110, housing 120, and upper-sub assembly 1702.

In FIG. 17, a ported 1712 distal end 1710 of a support sleeve 150 may be directly coupled to a seal assembly that extends below a distal end of the bottom sub assembly 110. In embodiments, after a cement squeeze job operation is formed, and upper-sub assembly 1702 is disconnected from bottom sub-assembly, upper sub-assembly 1702 and the seal assembly may be pulled out of the hole together, such that the distal end 1710 is positioned above the proximal end of bottom-sub assembly 110 and housing 120. However, the distal end of the seal assembly may still be positioned with bottom sub assembly 110 housing 120 and or casing below.

Figure 18:
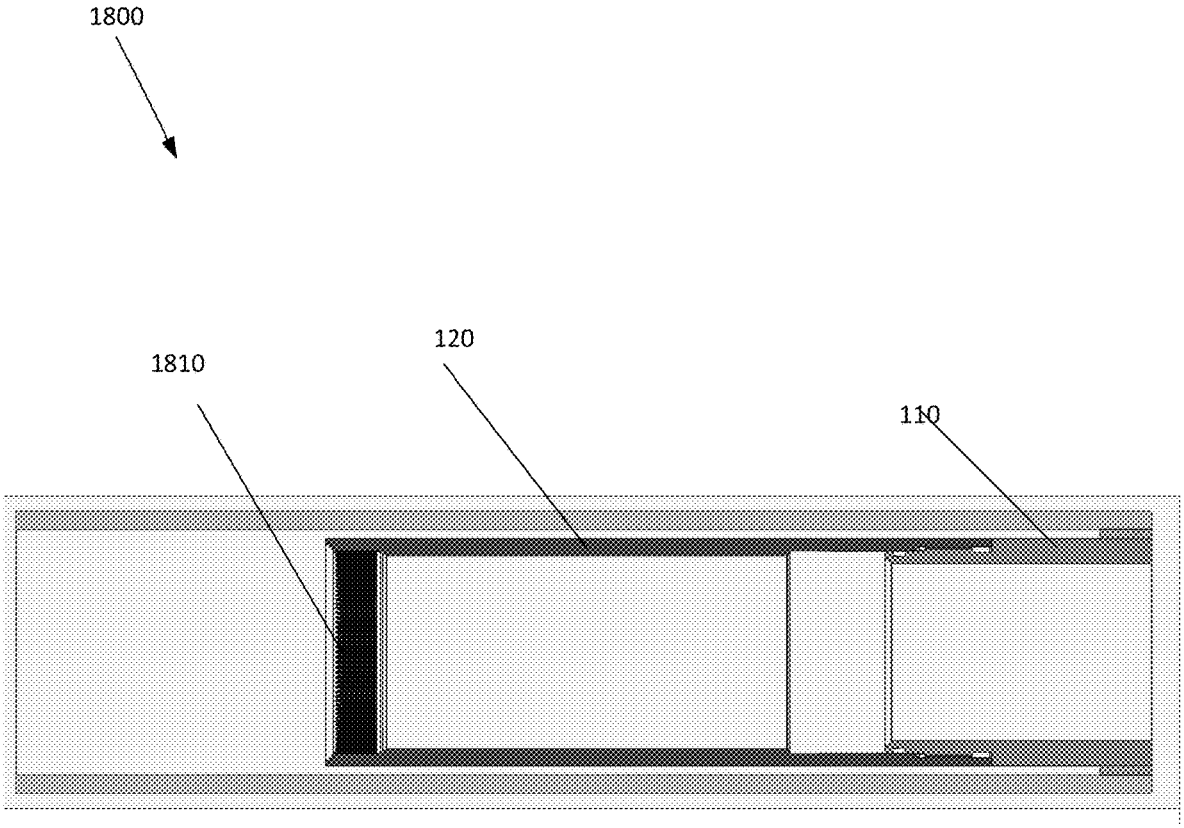
FIG. 18 depicts a tool, according to an embodiment.

FIG. 18 depicts an embodiment 1800 of housing 120 and bottom sub assembly 110. Elements in FIG. 18 may be described above, and for the sake of brevity a further description of these elements may be omitted.

As depicted in FIG. 18, a proximal end of housing 120 may include splines 1810. Splines 1810 may be a series of ridges, teeth, projections and depressions, etc. that are configured to interfaces or mesh with grooves, projections, etc. on a proximal end of outer sidewall of the upper sub-assembly. The splines 1810 and corresponding grooves on the outer sidewall of the upper sub-assembly may form an anti-rotation lock between the upper sub assembly and the bottom sub assembly 110. One skilled in the art may appreciate that any mechanical elements may be utilized to maintain the angular correspondence between bottom sub assembly 110 and the upper sub assembly, without changing an inner or outer profile of the detachable tool.

Figure 19:
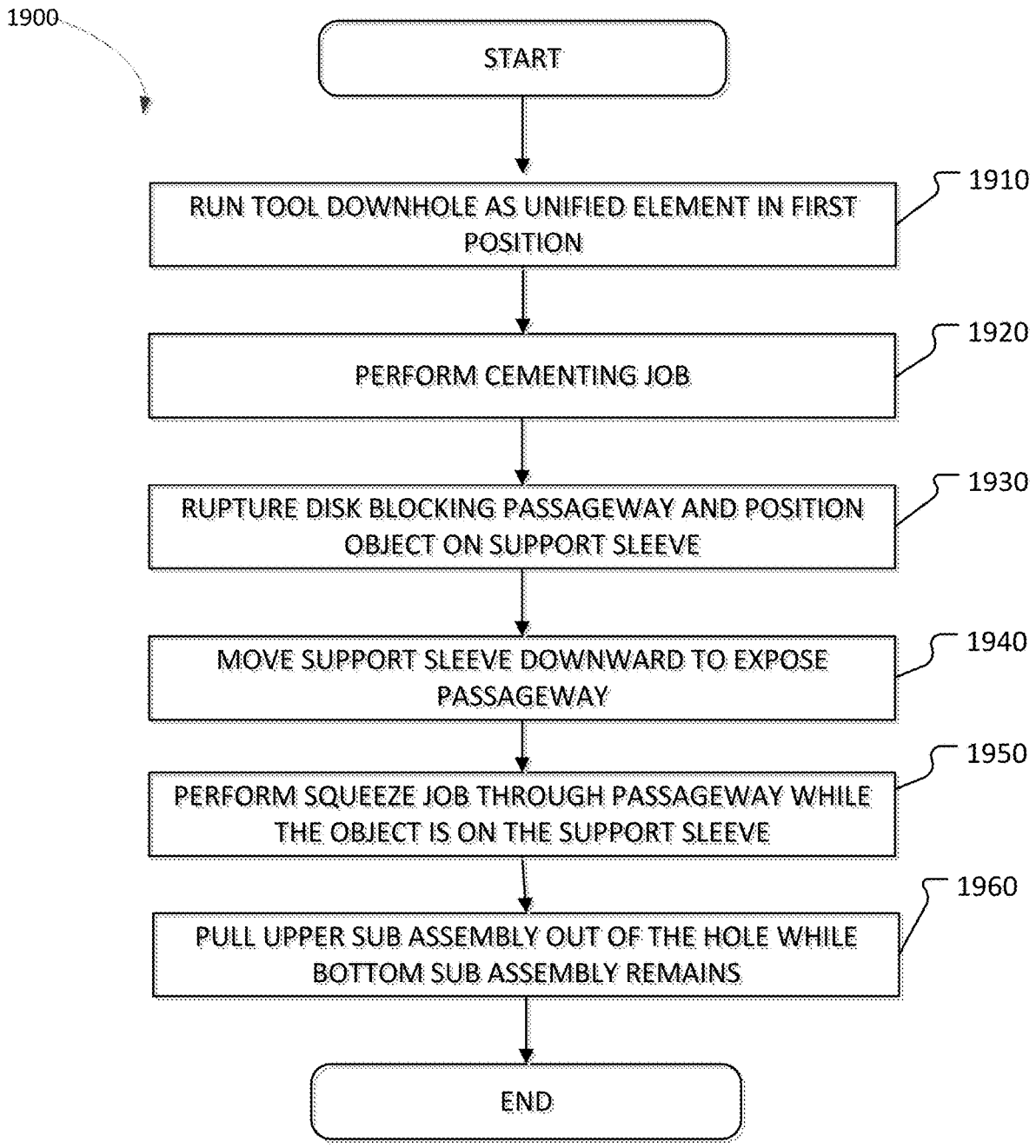
FIG. 19 depicts an interventionless method for detaching an upper sub-assembly from a bottom sub-assembly, according to an embodiment.

FIG. 19 depicts a method 1900 for an interventionless system for testing casing, according to an embodiment. The operations of method 1900 presented below are intended to be illustrative. In some embodiments, method 1900 may be accomplished with one or more additional operations not described, and/or without one or more of the operations discussed. Additionally, the order in which the operations of method 1900 are illustrated in FIG. 19 and described below is not intended to be limiting. Furthermore, the operations of method 1900 may be repeated for subsequent valves or zones in a well.

At operation 1910, a tool with housing, an upper sub-assembly, and bottom sub-assembly may be positioned within a wellbore on a shoe, wherein a seal assembly may be coupled to a distal end of the upper sub-assembly.

At operation 1920, a conventional casing cement job may be performed. The cement job may be performed by pumping cement through the tool, and having the cement return towards a surface in an annulus between the tool and a wellbore wall or existing casing. However, the cement may not return all the way to the surface and/or above a passageway extending through the upper sub assembly.

At operation 1930, a rupture disc blocking the passageway may be block and an object may be positioned on a support sleeve of the upper-sub assembly. The object may isolate and form a seal an area below the object from an area above the object.

At operation 1940, pressure in the area above the object within the tool may increase. Responsive to increasing the pressure above the object within the tool, a shear pin coupling the support sleeve to an adjuster sleeve may shear. The pressure may cause the support sleeve to move towards the distal end of the tool while the adjuster sleeve remains in place. This may position a proximal end of the support sleeve below the passageway.

At operation 1950, a cementing operation may be performed through the passageway while the proximal end of the support sleeve is positioned below the passageway and the object is isolating the first area from the second area.

At operation 1960, after the squeeze job is performed through the passageway, the upper sub assembly may be pulled out of the hole.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed:

1. A downhole tool comprising:

an upper subassembly with a central bore and a passageway, the passageway radially extending from an inner diameter of the upper subassembly to an outer diameter of the upper sub assembly, wherein the upper subassembly is retrievable;

a rupture disc positioned within the passageway configured to block the passageway;

a support sleeve retrievable with the upper sub-assembly; and an adjuster sleeve configured to be decoupled from the support sleeve at a first location after downward movement of the support sleeve relative to the adjuster sleeve, the rupture disc being ruptured when the support sleeve is coupled to the adjuster sleeve at the first location.

2. The downhole tool of claim 1, wherein a bottom subassembly is run in hole with the upper sub assembly, and the bottom subassembly remains downhole after the upper subassembly with the radially extending passageway is removed from a hole, wherein a rupture disc is configured to be positioned in the radially extending passageway; and a seal assembly is positioned on a distal end of the support sleeve, wherein the seal assembly extends through the bottom subassembly.

3. The downhole tool of claim 2, wherein the seal assembly is pulled out of the hole with the upper subassembly.

4. The downhole tool of claim 1, further comprising:

a port within the support sleeve that is aligned with the rupture disc when the support sleeve is coupled with the adjuster sleeve at the first location, wherein the rupture disc is configured to rupture before the support sleeve is decoupled from the adjuster sleeve at the first location.

5. A downhole tool comprising:

an upper subassembly with a central bore and a passageway, the passageway radially extending from an inner diameter of the upper subassembly to an outer diameter of the upper sub assembly, wherein the upper subassembly is retrievable;

a support sleeve that is retrievable with the upper subassembly;

and an adjuster sleeve configured to be decoupled from the support sleeve at a first location after downward movement of the support sleeve relative to the adjuster sleeve, wherein a seat is located on the support sleeve, wherein when a first object is positioned on the seat a first area below the first object is isolated from a second area above the first object, wherein a rupture disc positioned within the passageway is ruptured before pumping cement through the passageway, wherein the cement is pumped through the passageway during a squeeze job or an inner diameter of the downhole tool during a normal cementing job.

6. A disconnect downhole tool comprising:

an upper subassembly with a passageway;

a support sleeve;

and an adjuster sleeve configured to be decoupled from the support sleeve at a first location after a first object lands on a seat, wherein cement is pumped through the passageway after the adjuster sleeve is decoupled from the support sleeve;

a testing device including an outer housing with a hollow channel and a second object, the hollow channel extending from an upper surface of the outer housing to a lower surface of the outer housing, the second object increases an outer diameter across the outer housing;

an inner mandrel with a bypass and a seal, the bypass allowing fluid to flow through the hollow channel, the seal being configured to seal the hollow channel and the bypass when the seal is positioned within the hollow channel; and a temporary coupling mechanism configured to temporarily couple the inner mandrel and the outer housing, wherein the seal is positioned within the hollow channel when the temporary coupling mechanism is intact, wherein the hollow channel includes a no-go and the inner mandrel includes a projection, wherein the no-go and the projection are configured to limit the movement of the inner mandrel in a first direction.

7. The downhole tool of claim 6, wherein the outer housing and inner mandrel are configured to be pulled out of hole together based on forces applied by the projection against the no-go, and the outer housing and the inner mandrel are configured to be run in hole together.

8. The downhole tool of claim 7, wherein the downhole tool is used with a refrac disconnect system.

9. The downhole tool of claim 7, wherein the second object is a ball formed of dissolvable material.

10. The downhole tool of claim 9, wherein the second object has a seal stack.

11. The downhole tool of claim 7, wherein a first force threshold associated with the temporary coupling mechanism is less than a second force threshold associated with disconnecting the upper subassembly from the bottom subassembly.

12. The downhole tool of claim 7, wherein the bypass includes a conduit and ports, the conduit extending from the distal end of the inner mandrel towards a proximal end of the inner mandrel, and the ports extending from an outer surface of the inner mandrel into the conduit.

13. The downhole tool of claim 7, wherein the second object is configured to land on the bottom subassembly after the upper subassembly and seal assembly are pulled out of a hole.

14. The downhole tool of claim 6, wherein when the temporary coupling mechanism is intact a third area above the second object is isolated from a fourth area positioned below the second object.

15. The downhole tool of claim 14, wherein responsive to moving the inner mandrel in the first direction the third area and the fourth area are in communication with each other through the bypass.

16. A method associated with a downhole tool comprising:

positioning an upper sub assembly with a passageway downhole, the upper sub assembly being retrievable, the upper sub assembly including a central bore, a passageway, an adjuster sleeve, and a support sleeve, the passageway radially extending from an inner diameter of the upper subassembly to an outer diameter of the upper sub assembly;

decoupling the adjuster sleeve from the support sleeve at a first location after downward movement of the support sleeve relative to the adjuster sleeve blocking the passageway via a rupture disc positioned within the passageway;

rupturing the rupture disc when the support sleeve is coupled to the adjuster sleeve at the first location.

17. The method of claim 16, further comprising:

positioning a first object on a seat within the adjuster sleeve to isolate a first area below the object from a second area above the first object.

18. The method of claim 17, further comprising:

running in hole a bottom subassembly with the upper sub assembly, wherein the bottom subassembly remains downhole after the upper subassembly is removed from a hole;

positioning a seal assembly on a distal end of the support sleeve, wherein the seal assembly extends through the bottom subassembly.

19. The method of claim 16, further comprising:

temporarily coupling an inner mandrel and an outer housing of a testing device, the testing device including the outer housing and a second object, the outer housing including a hollow channel that extends from an upper surface of the outer housing to a lower surface of the outer housing, the second object increases an outer diameter across the outer housing, the inner mandrel with a bypass and a seal, the bypass allowing fluid to flow through the hollow channel, the seal being configured to seal the hollow channel and the bypass when the seal is positioned within the hollow channel, wherein the seal is positioned within the hollow channel when the inner mandrel is temporary coupled to the outer housing via a temporary coupling mechanism.

20. The method of claim 19, further comprising:

limiting the movement of the inner mandrel in a first direction via a no-go within the hollow channel and a projection associated with the inner mandrel.

* * * * *